US006571867B2

(12) United States Patent
Bond

(10) Patent No.: US 6,571,867 B2
(45) Date of Patent: Jun. 3, 2003

(54) APPARATUS FOR INCREASING THE EFFECTIVE DIAMETER OF A WELLBORE

(76) Inventor: Lesley O. Bond, 707 Peterson Rd., Neosho, MO (US) 64850

( * ) Notice: Subject to any disclaimer, the term of this patent is extended or adjusted under 35 U.S.C. 154(b) by 25 days.

(21) Appl. No.: 09/883,084

(22) Filed: Jun. 14, 2001

(65) Prior Publication Data

US 2002/0070013 A1 Jun. 13, 2002

Related U.S. Application Data

(63) Continuation of application No. 09/416,281, filed on Oct. 12, 1999, now Pat. No. 6,276,453, which is a continuation-in-part of application No. 09/228,680, filed on Jan. 12, 1999, now abandoned.

(51) Int. Cl.[7] ..... E21B 7/08; E21B 43/00

(52) U.S. Cl. ..... 166/50; 166/117.6; 166/227; 175/77; 175/78

(58) Field of Search ..... 166/50, 227, 313, 166/117.6; 175/77, 78, 62

(56) References Cited

U.S. PATENT DOCUMENTS

| | | | | |
|---|---|---|---|---|
| 702,006 A | * | 6/1902 | Huffman | 166/205 |
| 2,044,648 A | | 6/1936 | Stevens | |
| 2,353,435 A | | 7/1944 | Barnhart | |
| 2,539,047 A | | 1/1951 | Arutunoff | |
| 2,540,123 A | | 2/1951 | Kinley | |
| 2,642,267 A | | 6/1953 | Zublin | |
| 2,670,180 A | * | 2/1954 | Ranney | 166/100 |
| 2,709,070 A | | 5/1955 | Bielstein | |
| 2,797,893 A | | 7/1957 | McCune et al. | |
| 2,889,137 A | * | 6/1959 | Walker | 166/50 |
| 3,191,697 A | | 6/1965 | Haines | |
| 3,221,824 A | * | 12/1965 | Self | 166/214 |
| 3,301,337 A | | 1/1967 | Vaughn et al. | |
| 3,419,089 A | | 12/1968 | Venghiattis | |
| 3,797,576 A | | 3/1974 | Azalbert et al. | |
| 4,051,908 A | | 10/1977 | Driver | |
| 4,354,558 A | | 10/1982 | Jageler et al. | |
| 4,461,360 A | | 7/1984 | Mount, II | |
| 4,629,011 A | | 12/1986 | Reinhardt | |
| 4,640,362 A | | 2/1987 | Schellstede | |
| 4,694,911 A | | 9/1987 | Kennedy | |
| 5,228,518 A | * | 7/1993 | Wilson et al. | 166/100 |
| 5,332,049 A | | 7/1994 | Tew | |
| 5,373,906 A | | 12/1994 | Braddick | |
| 5,435,400 A | | 7/1995 | Smith | |
| 5,622,231 A | | 4/1997 | Thompson | |
| 5,687,806 A | | 11/1997 | Sallwasser et al. | |
| 5,699,866 A | | 12/1997 | Cousins et al. | |
| 5,915,474 A | | 6/1999 | Buytaert et al. | |

FOREIGN PATENT DOCUMENTS

| | | |
|---|---|---|
| DE | 195 16 438 A1 | 12/1995 |
| EP | 0 859 123 A2 | 8/1998 |
| GB | 2 067 233 A | 7/1981 |
| WO | WO 99/29997 | 6/1999 |

* cited by examiner

*Primary Examiner*—Hoang Dang
(74) *Attorney, Agent, or Firm*—Mary M. Lee

(57) ABSTRACT

A method and apparatus for forcing drainage devices through the sidewall of a borehole and into the formation to increase oil and gas recovery from the formation. The object usually comprises a plurality of drainage devices, which may be a plurality of nesting discs perforated to provide a passageway for recovery fluid. The discs and drainage device are forced non-drillingly through the side wall and into the formation. The apparatus and method also may be used with interconnected links instead of discs to push a core sampler into the formation and retrieve it. The housing includes a guide channel that is usually an angled passageway or tube. The discs or links are sized to be received in the guide. The apparatus includes a propulsion assembly that impacts the discs or links that act as an anvil assembly. Alternatively, the apparatus takes the form of a pre-loaded casing section, that is, a casing section in which a plurality of drainage devices have been incorporated. A bit pushed through the casing forces the drainage devices out into the formation.

15 Claims, 23 Drawing Sheets

APPARATUS FOR INCREASING THE EFFECTIVE DIAMETER OF A WELLBORE

CROSS REFERENCE TO RELATED APPLICATION

This application is a continuation of application Ser. No. 09/416,281, filed Oct. 12, 1999, entitled Method and Apparatus for Forcing an Object Through the Sidewall of a Borehole, now U.S. Pat. No. 6,276,453, which is a continuation-in-part of application Ser. No. 09/228,680, filed Jan. 12, 1999, entitled Method and Apparatus for Increasing the Effective Diameter of a Wellbore, now abandoned, and the contents of both these applications are incorporated herein by reference.

FIELD OF THE INVENTION

The present invention relates generally to apparatuses and methods for disposing an object through the sidewall of a borehole.

SUMMARY OF THE INVENTION

The present invention is directed to an apparatus for disposing an object through the sidewall of a borehole in a compressible substance. The apparatus comprises an object positionable within the borehole and a propulsion assembly disposable into the borehole. The propulsion assembly includes a propulsion member adapted to move axially within the borehole and impact the object whereby the object is forced non-drillingly through the sidewall of the borehole a distance into the compressible substance without creating a significant amount of cuttings.

The present invention is directed to an apparatus for disposing an object through the sidewall of a borehole. The apparatus comprises an object positionable within the borehole and a propulsion assembly. The propulsion assembly is disposable in the borehole and comprises a reciprocating shaft adapted to move axially within the borehole and impact the object whereby the object is drivable a distance radially through the sidewall of the borehole.

The present invention further includes an apparatus for disposing an object through the sidewall of a borehole. The apparatus comprises a housing movably positionable within the borehole, a percussive assembly, and an anvil assembly. The housing defines a plurality of guides terminating at an end adjacent the sidewall of the borehole. Each guide is characterized by the ability to maintain the object in a desired orientation in the borehole while the object is driven into the formation. The percussive assembly comprises a reciprocating shaft having a downhole percussive end, and is capable of imparting a percussive force. The anvil assembly is disposable within the guide and is capable of transmitting the percussive force from the percussive assembly to the object, whereby the object is drivable a distance through the sidewall of the borehole and into the earth.

The present invention further includes a system for increasing the effective diameter of a wellbore traversing a subterranean formation from which hydrocarbons and the like are recoverable. The system comprises a wellbore casing, a plurality of objects, and a percussive assembly. The wellbore casing has an uphole end, a downhole end, a sidewall, and a plurality of guides. The wellbore casing is adapted to fit inside a wellbore. Each of the objects is disposable within a guide. The percussive assembly is movably positionable within the casing for extending the objects through the casing and into the subterranean formation. The percussive assembly comprises a reciprocating shaft and a hole opener. The reciprocating shaft has an uphole end, a downhole end, and a bit extending from the downhole end. The bit is adapted to percussively impact the objects whereby the object is drivable a distance through the casing and the sidewall of the wellbore. The hole opener is connectable to the reciprocating shaft, and comprises a first portion and a second portion. The first portion is connectable to the reciprocating shaft. The second portion is movably connectable to the reciprocating shaft and has a plurality of fingers extending radially therefrom. The second body portion is movably positionable adjacent the first body portion, and the plurality of fingers are radially extendable about the second body whereby the fingers are adapted to impact the object and drive the object a distance further into the sidewall of the wellbore.

The present invention further includes a casing for increasing the effective diameter of a wellbore traversing a subterranean formation from which hydrocarbons and the like are recoverable. The casing comprises a plurality of objects positionable within the wellbore and an external tube. The external tube has an uphole end, a downhole end, and a plurality of guides. Each guide is characterized by the ability to maintain the object in a desired orientation while the object is driven into the sidewall of the wellbore and into the subterranean formation, whereby the effective diameter of the wellbore is increased.

The present invention further includes a plurality of discs for disposing an object into the sidewall of a borehole. Each disc comprises a circular body having an upper surface and a lower surface. The discs are positionable within a guide in the borehole so that, when stacked adjacent with another like disc, the discs are nestable therein. The discs are capable of lateral movement within the guide whereby the discs conform to the shape of the guide. The discs are capable of receiving and transmitting a propulsion force to the object whereby the object is driven a distance through the sidewall of the borehole and into the earth. The disks are adapted to provide a flow path for fluid through the borehole.

The present invention further includes a method for disposing an object in a sidewall of a borehole. The method comprises transmitting a force through a borehole and onto the object whereby the object is advanced into the sidewall of the borehole.

The present invention further includes a method for disposing an object in a sidewall of a borehole. The method comprises transmitting a force axially through a borehole and onto the object whereby the object is advanced radially into the sidewall of the borehole.

The present invention further includes an apparatus for disposing an object through the sidewall of a borehole. The apparatus comprises a housing movably positionable within the borehole, an explosive assembly and an anvil assembly. The housing defines a pressurized chamber and a guide. The guide terminates at an end adjacent the sidewall of the borehole and is characterized by the ability to maintain the object in a desired orientation in the borehole while the object is driven into the formation. The explosive assembly comprises at least one explosive charge disposable in the pressurized chamber, an activator for igniting the explosive charge, and a piston. The explosive assembly is capable of imparting an explosive force. The piston is disposable within the pressurized chamber and drivable a distance downhole into the guide. The anvil assembly is capable of transmitting the explosive force from the explosive assembly to the object whereby the object is drivable a distance through the sidewall of the borehole and into the earth.

Finally, the present invention includes an apparatus for disposing an object through the sidewall of a borehole. The apparatus comprises a housing movably positionable within the borehole, a hydraulic assembly and an anvil assembly. The housing defines a pressurized chamber and a guide. The guide terminates at an end adjacent the sidewall of the borehole and is characterized by the ability to maintain the object in a desired orientation in the borehole while the object is driven into the formation. The hydraulic assembly comprises a hydraulic pump capable of creating pressure within the pressurized chamber and a piston. The hydraulic assembly is capable of imparting a hydraulic force. The piston is disposable within the pressurized chamber and drivable a distance downhole into the guide. The anvil assembly is capable of transmitting the hydraulic force from the hydraulic assembly to the object whereby the object is drivable a distance through the sidewall of the borehole and into the earth.

BRIEF DESCRIPTION OF THE DRAWINGS

FIG. 9 shows a longitudinal sectional view of a second embodiment of the present invention comprising a linkage assembly and using a sampler.

FIG. 11 shows a longitudinal sectional view of a third embodiment of the present invention comprising a bit and a hole opener and using an expansion device in a pre-loaded casing.

FIG. 19 shows a perspective view of another embodiment of the drainage device of FIG. 8 employed in the embodiment of FIG. 16, wherein the drainage device is a shaft defining a helical channel.

FIG. 31 shows a cross sectional view of the disc of FIG. 23 having a diameter a.

DETAILED DESCRIPTION OF THE PREFERRED EMBODIMENTS

Figure 1:
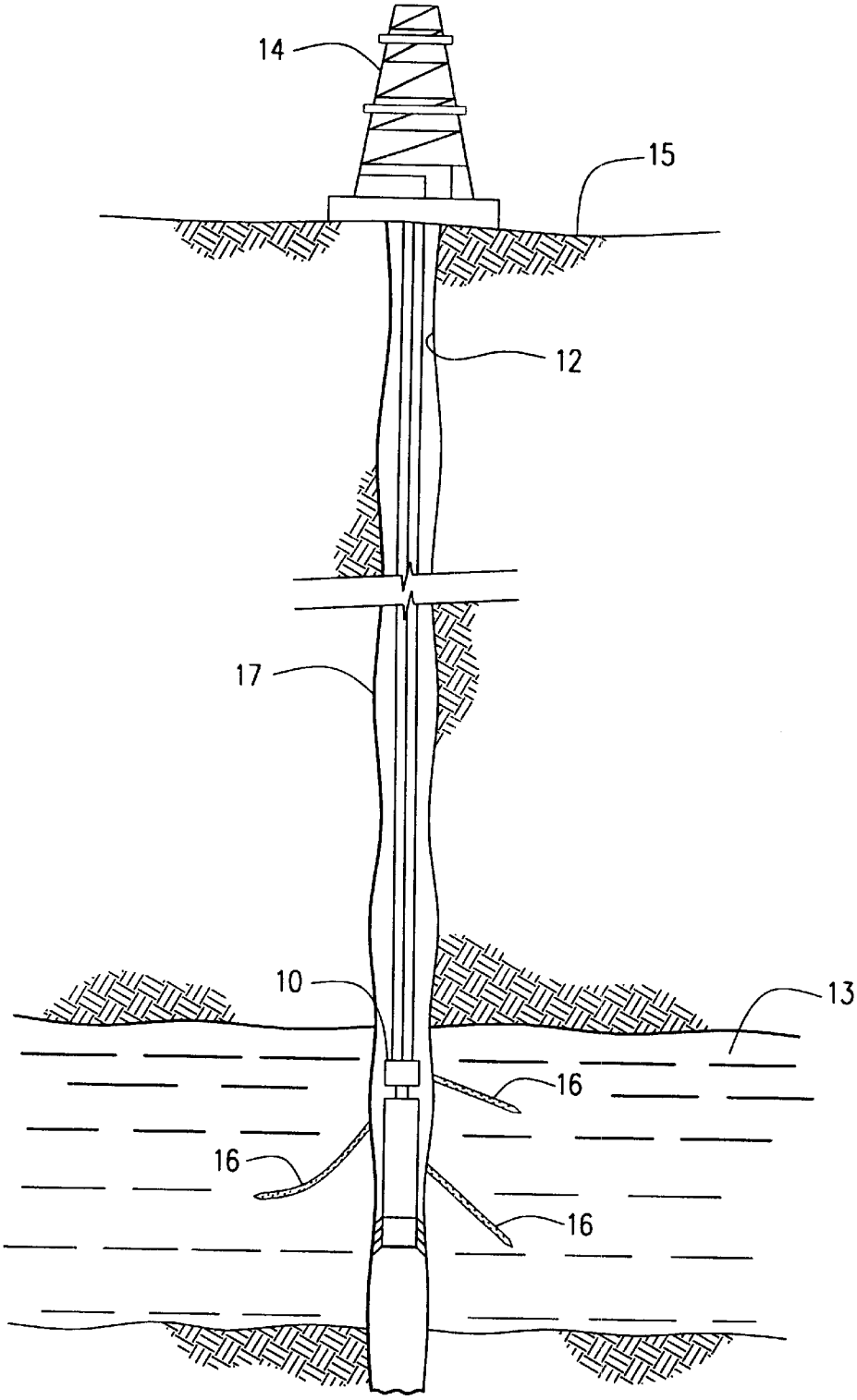
FIG. 1 shows a longitudinal sectional view of the apparatus in a wellbore below the earth in accordance with the present invention.

The production of commercially valuable products from reservoir rock is measured not only by the rate of production from the associated well, but also by the life of the well. The longer a well produces commercially valuable quantities of oil and gas, the more valuable that well will be. Optimizing production while maintaining the longevity of the well is the ultimate goal of oil and gas producers.

Reservoir performance is measured by a number of factors including permeability, porosity and thickness of the reservoir rock or formation, and the pressure of the formation. The formation pressure is the energy that drives oil and gas through the reservoir toward the well.

In radial flow patterns, typically present in the production of oil and gas, the pressure driving the liquids entrained in the reservoir through the formation and into the well varies, depending upon the distance from the well. In other words, flow rate is a function of the pressure differential between the well and the various distances throughout the formation. The radial flow rate of liquid within a reservoir is determined by the equation:

$$Q = \frac{2kh(P_r - P_w)}{\ln R_r / R_w}$$

wherein:

Q=flow rate of the reservoir liquid, k=permeability constant, h=the thickness of the reservoir rock, $P_r$=the pressure of the reservoir rock, $P_w$=the pressure at the well, =the viscosity of the reservoir liquid, $R_r$=the radius of the reservoir, and $R_w$=the radius of the well=one half the diameter of the well.

As fluids flow through the reservoir and approach the well, fluid velocity increases due, at least in part, to a decrease in the cross-sectional area of the reservoir rock near the well. This results in pressure losses in the formation. In radial flow patterns, the greatest amount of energy required to move oil to the well is consumed within a few feet of the well. In other words, the greatest pressure losses take place within a few feet of the well.

The natural pressure of the formation, and thus the life of the well, may be preserved by increasing the well diameter or the amount of area exposed to drainage, thereby decreasing the velocity of liquids approaching the well and the loss of pressure due to friction with the formation rock. Increasing the well diameter increases the area through which fluid can flow. Thus, increasing the cross-sectional area of flow, or the effective diameter of the well, conserves reservoir energy and increases recovery.

Various methods have been used to try to increase the effective diameter of wells, but have offered little success. One such method is to drill shafts or tubing into the producing formation using a rotary drive mechanism. These shafts bore through the casing and into the formation a distance, thereby increasing the diameter of the well and reducing the distance the reservoir fluids must travel. Using knucklejoints or U-joints enables the shafts to deform around curves and enter the formation. However, these mechanical joints tend to fail under strain caused by drilling. The shaft is forced to travel out of the well at an angle and into the reservoir. The resultant forces make unusual and severe demands upon the downhole mechanism. Torque applied to the shaft can shear the downhole tools, which interrupts the operation, increases costs and may result in loss of the well if the downhole tools are not recoverable.

Moreover, these drilling and boring methods produce cuttings that have to be removed from the well. Some mud systems are required to transport cuttings from the hole. Frequently, the pressure in the formation is lower than the pressure in the borehole. The drilling fluid, which naturally flows toward the area of lower pressure, flows into the formation rather than up the annulus of the well to the surface. When the flow is toward the formation, the resultant packing off around the bit causes the bit to jam and the torque-carrying device is twisted off in the well.

The present invention provides an apparatus and method for forcing an object through the sidewall of a borehole by non-rotary force. This non-rotary approach compresses the surrounding formation and thus produces little or no spoils or cuttings. Using the method and apparatus of this invention a drainage device may be inserted in the formation through the wellbore for increasing the effective diameter of the well. The apparatus includes a tool that imparts a propulsion force axially through the borehole to force drainage devices into the producing formation. This reduces many of the problems of rotary drilling which include the inability to penetrate the well casing, the inability to drill through a variety of soil types, the high failure rate of mechanical parts, and the back-flow of drilling fluids and earth that are generated during the drilling operations.

Tools have previously been provided for completing downhole drilling operations. Such devices known in the well drilling industry include percussion drilling tools sometimes referred to as "down-hole-percussion drill motors", as more particularly described in U.S. Pat. No. 4,694,911, the entire contents of which is hereby incorporated by reference. However, such percussion drilling tools are primarily restricted to axially oriented drilling operations. The present invention overcomes the deficiencies of the existing rotary drilling tools by providing an apparatus that is capable of using a propulsion force, such as a percussive, explosive, and/or hydraulic force, to penetrate a wellbore and drive an object into a subterranean formation whereby the effective diameter of the wellbore is increased.

Turning now to the drawings in general, and to FIG. 1 in particular, there is shown therein the apparatus 10 depicted in the environment in which the apparatus of this invention is utilized. Wellbore 12 is located within a subterranean formation 13 below the earth's surface 15. An oil rig 14 is located above the wellbore 12 and pumps hydrocarbons, such as oil, from the subterranean formation 13. The apparatus 10 is disposed inside wellbore 12 to impart a propulsion force on a drainage device 16 whereby the drainage device 16 is driven through the sidewall 17 of the wellbore 12 and into the subterranean formation 13, thereby increasing the effective diameter of the wellbore 12.

It will be appreciated that, while the wellbore 12 depicted in FIG. 1 is a generally vertical hole used in the production of oil and gas from subterranean formations, the present invention is adapted for use in a variety of wellbores. The term "wellbore" as used herein encompasses a variety of holes in the earth including boreholes that are generally horizontal, vertical, linear, non-linear curved, at various other angles, or combinations thereof. Similarly, the term "earth" as used herein encompasses a variety of soil conditions including soil, rock, porous and permeable subterranean formations, fluids and gas, and other components within the earth.

Figure 2:
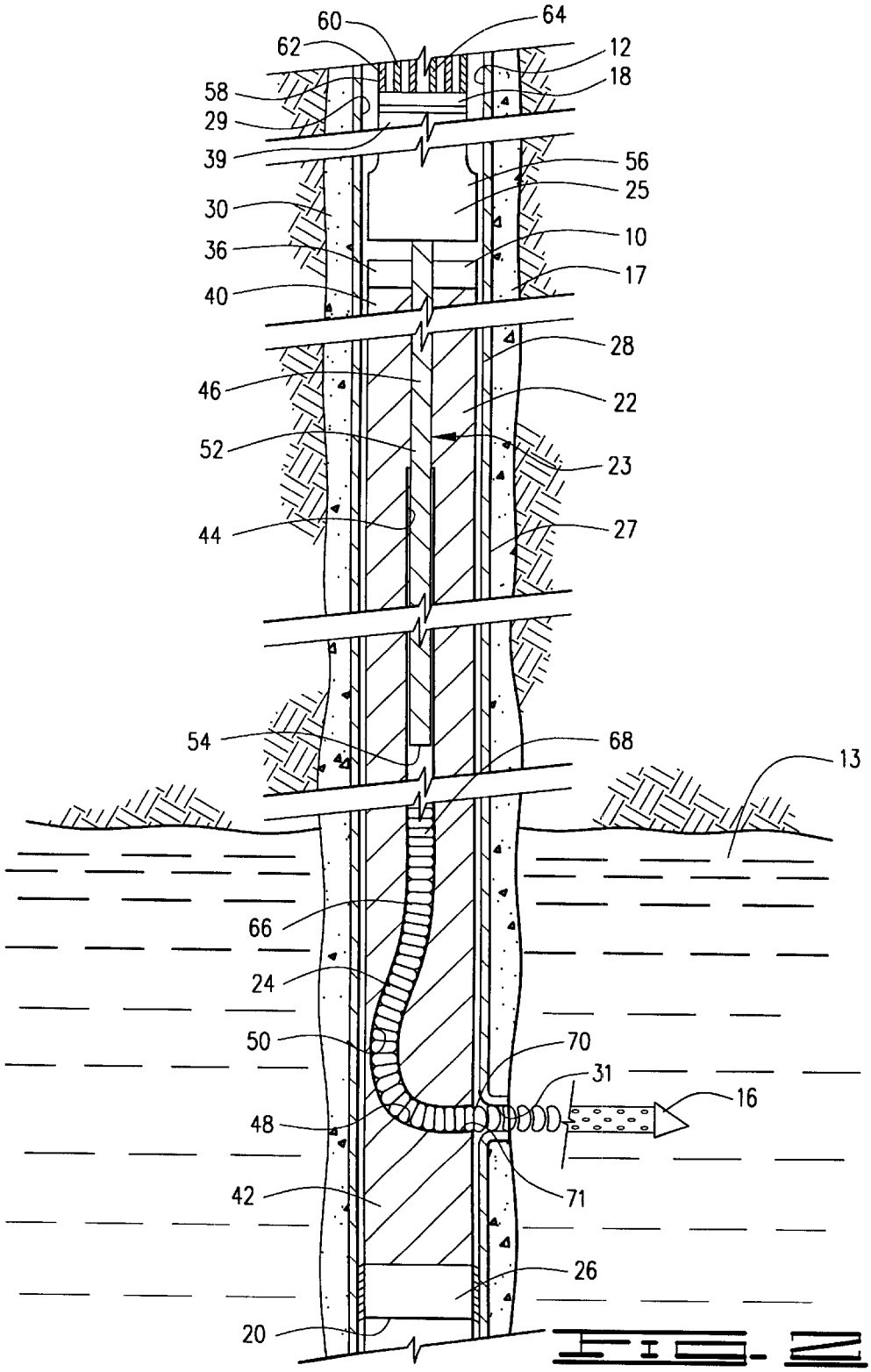
FIG. 2 shows a longitudinal sectional view of a first embodiment of a bore increasing apparatus, comprising a disc assembly, used to install a drainage device installed in a wellbore in accordance with the present invention.

Turning to FIG. 2, one embodiment of the present invention is shown. The embodiment of FIG. 2 shows the apparatus 10 having an uphole end 18 and a downhole end 20. The apparatus 10 preferably comprises a housing 22 movably positionable within the wellbore 12, a propulsion assembly such as percussive assembly 23 capable of imparting a force, an anvil assembly such as disc assembly 24 capable of transmitting the percussive force to a drainage device 16, and an anchor 26.

As seen in FIG. 2, the apparatus 10 is disposed in wellbore 12 having an internal tubular casing 28 that lines at least a portion of the sidewall 17 of the wellbore 12. The casing 28 has a sidewall 27. An annular space 29 remains between the apparatus 10 and the casing 28 of the wellbore 12. A layer of cement 30 bonds the casing 28 to the sidewall 17 of the wellbore 12 to secure it within the wellbore 12. The apparatus 10 is used to impart a force that drives the drainage device 16 through the casing 28, the cement 30, and the sidewall 17 of the wellbore 12 and into the subterranean formation 13. The drainage device 16 forms an aperture 31 in the casing 28 when driven through the casing and into the subterranean formation 13.

The casing 28 is a solid, tubular casing or casing string, usually formed of connected sections, common to the oil and gas industry. However, it should be appreciated that a variety of casings may be used in conjunction with the present invention. The apparatus may be disposed in an existing wellbore having an existing casing therein. Alternatively, a casing may be installed into the wellbore to be penetrated by the apparatus. The casing employed in conjunction with the apparatus may be adapted for penetration by providing it with apertures, as in FIG. 8, or pre-loaded drainage devices, as in FIGS. 10 and 11, as will be described herein.

The apparatus 10 is disposable a distance downhole within the wellbore 12. The apparatus 10 may be lowered downhole into position using any means or method. One preferred device is a hoist (not shown) supported on drill rig 14. The hoist lowers and raises the apparatus 10 to a desired depth within the wellbore 12. It should be understood that other devices capable of lowering the apparatus 10 to the desired position in the wellbore 12 may also be used. One such device is a drill pipe having more than one conductor, such as a pipe comprising three concentrically arranged tubular members. Alternately, a single member drill pipe or tubing could be employed. Both types of drill pipe would be used with a drill rig to raise and lower the pipe. Still further, a winch truck could be used to extend and retract a wire-line cable, the cable being capable of conducting electrical current and carrying the weight of the downhole tools.

The apparatus 10 preferably is anchored at a predetermined depth within the wellbore 12 via anchor 26, connected to the downhole end 20 of the apparatus 10. Alternatively, the downhole end 20 of apparatus 10 may rest directly on the bottom 32 of the wellbore 12, without the use of any anchoring device, as depicted in FIG. 9. However, it is often desirable to anchor the apparatus 10 at locations above the bottom 32 of the wellbore 12. The ultimate location of the device depends on the depth of the subterranean formation 13 and the desired depth at which work is to be done within the formation.

Figure 22A:
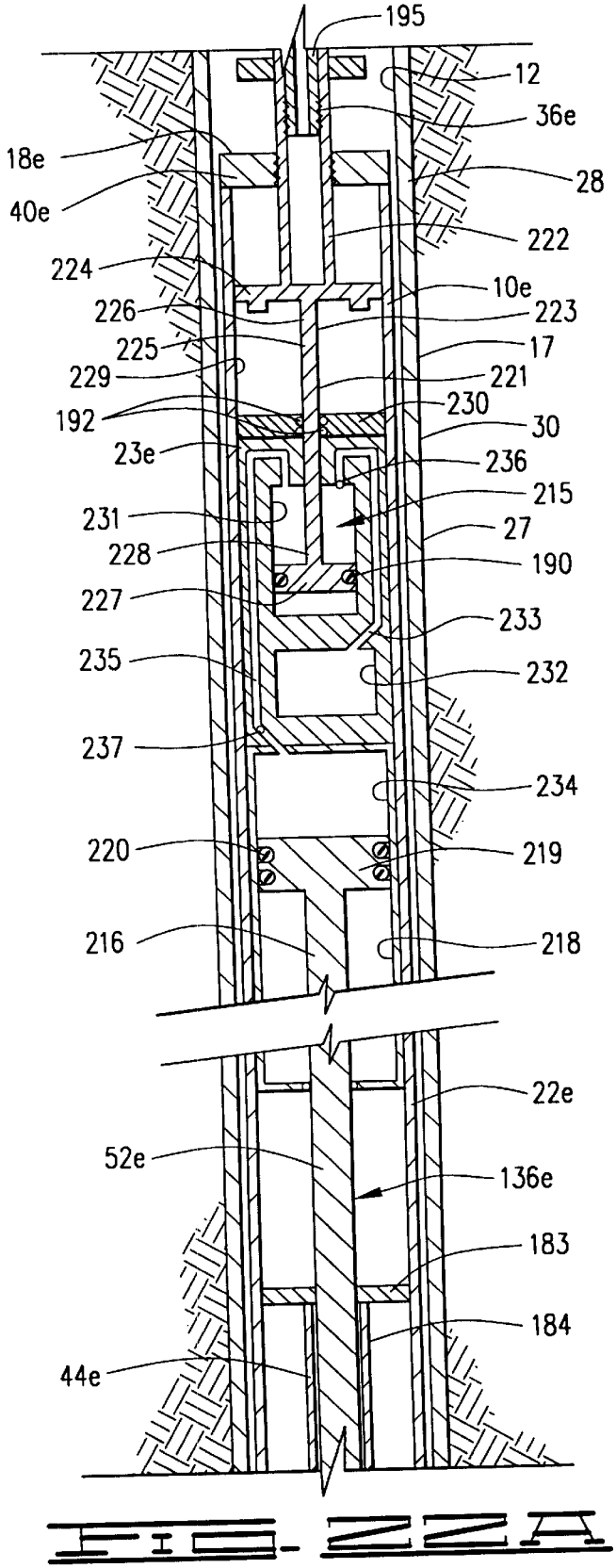
FIG. 22A shows a top portion of a longitudinal sectional view of a sixth embodiment of the present invention comprising a hydraulic assembly and a disc assembly, used to install a drainage device installed in a wellbore in accordance with the present invention.
Figure 22B:
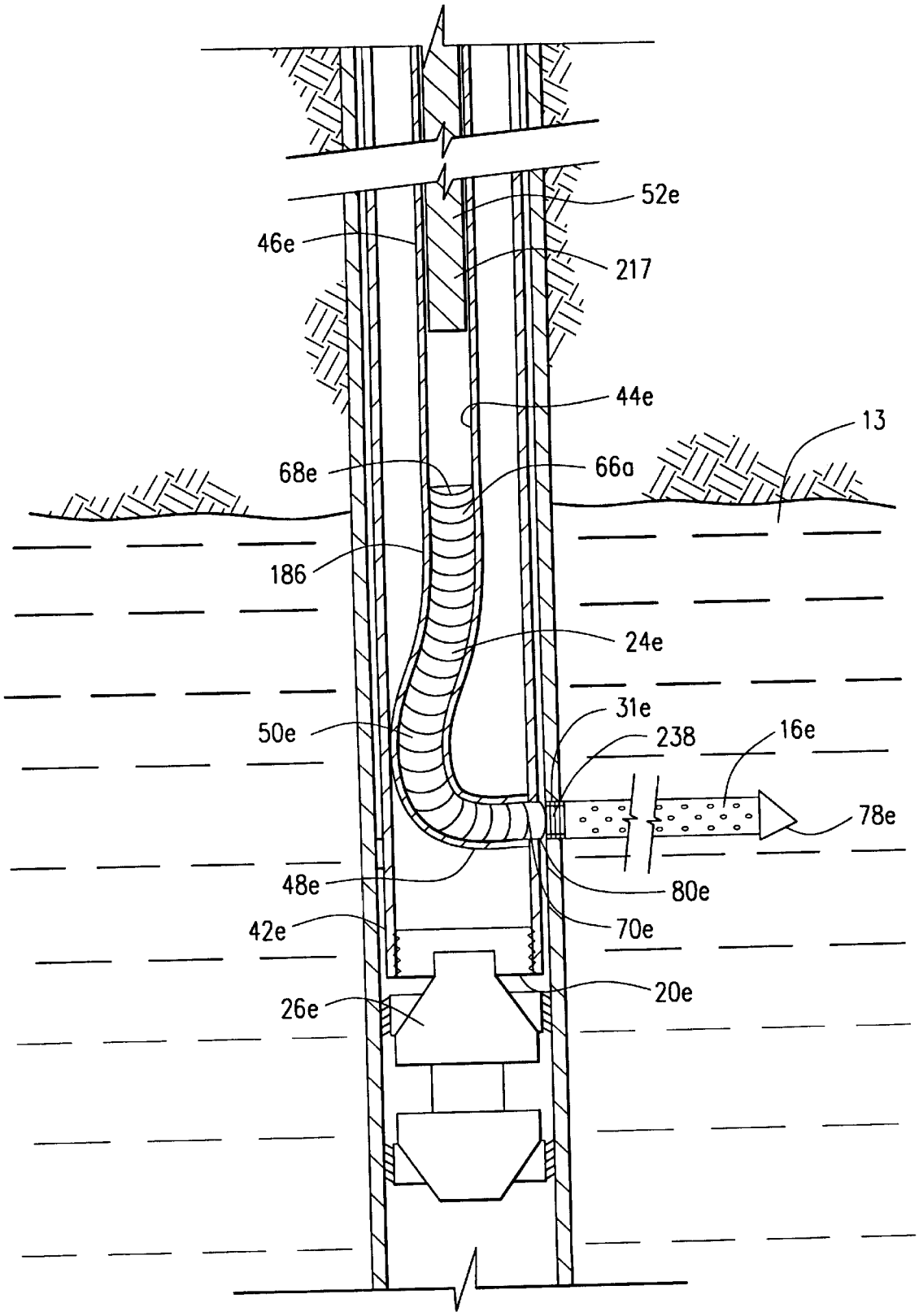
FIG. 22B shows a bottom portion of the longitudinal sectional view of the embodiment of FIG. 22A.

It should also be appreciated that the apparatus 10 may be anchored within the wellbore by placing the anchor at various locations on the apparatus. For example, a single anchor may be located at the downhole end of the apparatus or at the uphole end of the apparatus. Alternatively, anchors may be placed at multiple positions on the apparatus, such as at the uphole end, the downhole end, or combinations thereof. As seen in FIG. 22B, a dual anchor may be placed at the downhole end of the apparatus as will be described more fully herein.

Figure 3:
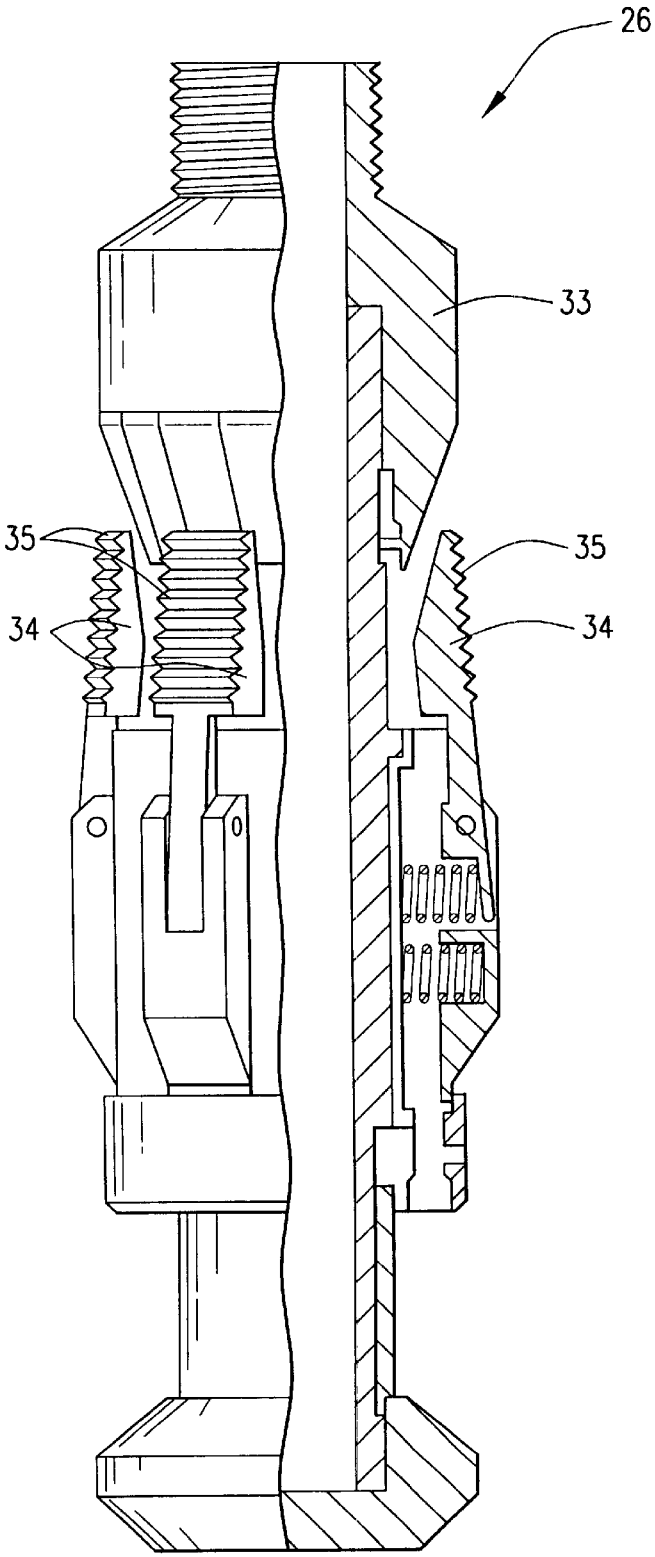
FIG. 3 shows a partially sectional view of the anchor of FIG. 2.

Referring now to FIG. 3, the anchor 26 of the apparatus 10 is depicted in greater detail. The anchor 26 can be any suitable conventional anchor used in the oil industry. The anchor 26 generally comprises a body portion 33 and plurality of slips 34 extending radially therefrom. The slips are provided with a plurality of teeth 35 that are adapted to frictionally engage the sidewall 17 of the wellbore 12 (FIG. 2) and resist movement therefrom.

The anchor 26 is set by rotating the apparatus 10 clockwise with a small amount of torque and then applying tension by pulling up on the apparatus. The drag springs on the anchor prevent it from rotating when torque is applied. As the internal slips screw is elongated, the slips traveling on an inclined plane make contact with the casing wall and prevent the tool from moving up or down when force is applied. The slips 34 of the anchor 26 are moved to the set position within a slot (not shown) so that the slips 34 extend radially about the anchor 26. The slips 34 push against the sidewall 17 of the wellbore 12 and prevent the apparatus 10 from moving within the wellbore 12. One set of slips prevents the upward movement and another set of slips prevents the downward movement. The slips are released by reducing the upward tension and turning the apparatus in the clockwise direction.

Referring back to FIG. 2, while the apparatus 10 is being secured at the desired depth within the wellbore 12, it is preferable to maintain the percussive assembly 23 stationary. The percussive assembly 23 is preferably locked into place within the apparatus 10 via a releasable lock assembly 36. Once the anchor 26 is set, or the apparatus 10 otherwise secured, the lock assembly 36 may be released and the percussive assembly 23 activated.

Figure 4:
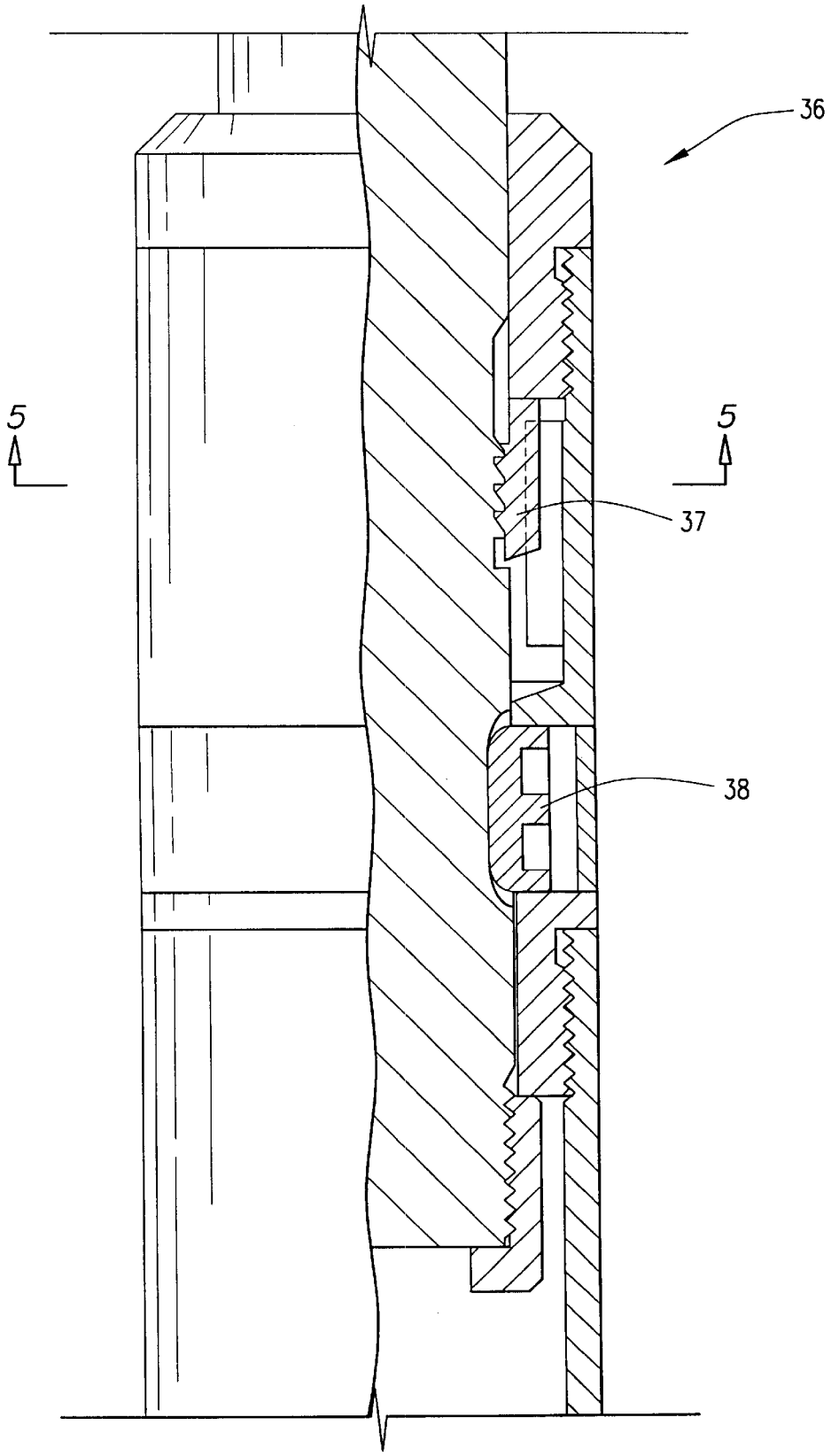
FIG. 4 shows a partially sectional view of the lock assembly of FIG. 2.
Figure 5:
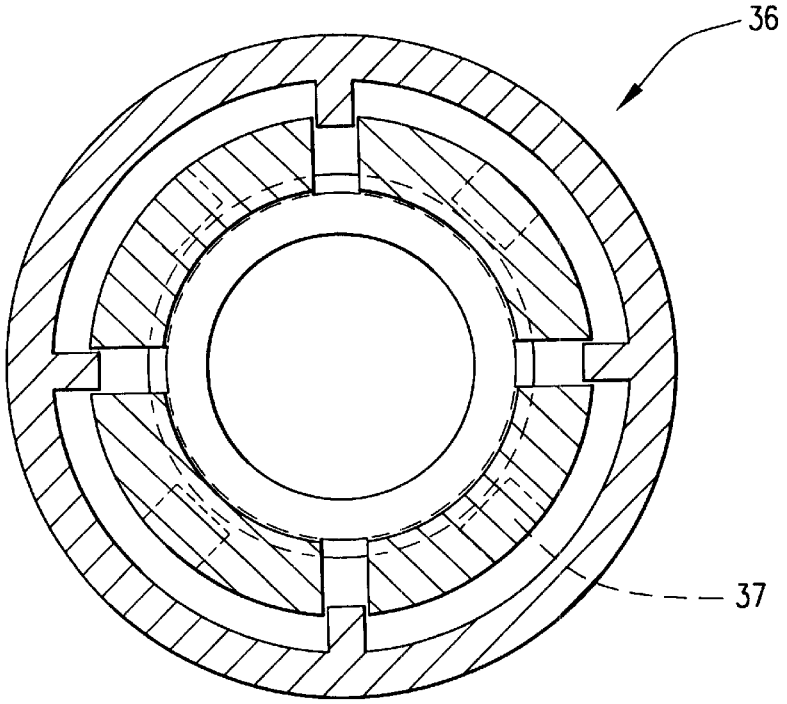
FIG. 5 shows a cross sectional view of the lock assembly of FIG. 4 taken along line 5—5 in FIG. 4.

Referring now to FIGS. 4 and 5, the preferred releasable lock assembly 36 is depicted. The lock assembly 36 is generally cylindrical collar comprising a fluted spring-loaded locking nut, such as a dizzy nut 37, and a set of torque dogs 38.

Lock assemblies, such as the one depicted in FIG. 4 and 5, are common in the oil and gas industry. By rotating the dizzy nut 37, the spring loaded torque dogs 38 shift the dizzy nut 37 within the lock assembly 36 whereby the reciprocating shaft 52 is released so that it may reciprocate within the housing 22. (See FIG. 2.) By rotating the dizzy nut 37 in the opposite direction, the torque dogs 38 shift the dizzy nut 37 to the locked position and the reciprocating shaft 52 is re-secured within the housing 22 of the apparatus 10.

Referring back to FIG. 2, the apparatus 10 is provided with a shear mechanism 39. The shear mechanism 39 is located at the top of the apparatus 10 and is adapted to shear and release at least a portion of the apparatus 10, which is stuck in the wellbore 12. Such shear mechanisms are common in the oil and gas industry and are typically used to remove equipment from the wellbore.

The housing 22 of the apparatus 10 preferably is generally cylindrical with an uphole portion 40 and a downhole portion 42. The housing 22 may comprise a solid body with a guide 44 therethrough for purposes yet to be described. It should be appreciated that while the housing 22 seen in FIG. 2 has a solid body, the housing 22 may be any shape, such as solid, hollow with a supportable tube therein as seen in FIGS. 22A and B, or a combination thereof as shown in FIG. 9, as will be more particularly described herein.

With continuing reference to FIG. 2, the guide 44 preferably defines an elongate aperture within the guide 44 adapted to hold the drainage device 16 in the proper orientation for release. The guide 44 preferably comprises a generally linear upper portion 46, a directional downhole portion 48 and a middle portion 50 therebetween. The directional downhole portion 48 is configured to direct the drainage device 16 to the desired location within the subterranean formation 13 and at the desired orientation.

The middle portion 50 defines a transition area between the upper portion 46 and lower portion 48, and preferably defines an elbow linking the linear upper portion 46 to the directional downhole portion 48 at a radius sufficient to permit the drainage device 16 to pass through the guide 44.

While the embodiment of FIG. 2 shows a generally axial upper portion, a curved middle portion and a generally radial directional downhole portion, it will be appreciated that the shape of the guide 44 may be of any shape and the directional downhole portion can be oriented in any direction as long as the end of the guide 44 is positionable at a predetermined location adjacent the sidewall 17 of the wellbore 12.

The shape of the guide 44 and the orientation of the directional downhole portion 48 determine the angle at which the object exits the guide 44 and penetrates the subterranean formation 13. In the preferred embodiment shown in FIG. 2, the linear portion 46 of the guide 44 forms a 90 degree angle to the directional downhole portion 48, thereby creating a 90 degree exit angle for the drainage device 16. It should be understood that the angle of the linear upper portion to the directional downhole portion of the guide may be any angle required to drive the drainage device 16 into the formation 13, such as the 120 degree exit angle shown in FIG. 9.

Figure 16:
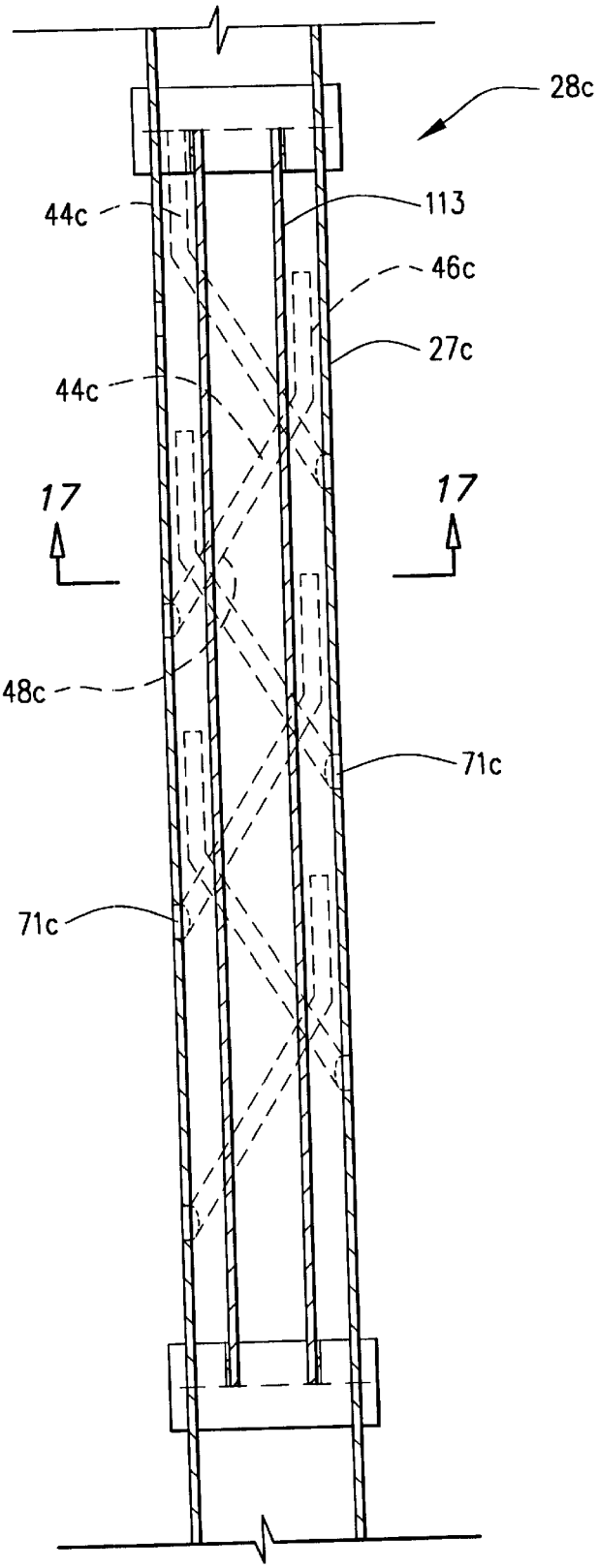
FIG. 16 shows a longitudinal sectional view of a fourth embodiment of the present invention comprising the third embodiment of FIG. 11 and a pipe retriever, and using a drainage device in a pre-loaded casing.

With continuing reference to FIG. 2, the guide 44 may be integrally formed within the housing 22 as an aperture extending through the housing 22. However, it should be understood that the guide 44 may be separate from the apparatus, as shown in the embodiment of FIG. 16 and the casing of FIG. 13.

The percussive assembly 23 comprises a reciprocating shaft 52 terminating in a downhole percussive end 54, a hammer 56, and a string assembly 58. A portion of the reciprocating shaft 52 is disposed within the hammer 56 and extends a distance downhole from the hammer 56 and into the linear upper portion 46 of the guide 44.

The hammer 56 operates via pneumatic pressure created by the string assembly 58 as more particularly described in U.S. Pat. No. 4,694,911, previously incorporated herein. The three string assembly preferably comprises three concentric pipes fabricated in such a way as to prevent intercommunication between the three pipes: a high pressure string 60 in the middle, a low pressure string 62 on the outside, and an inner circulation string 64.

The three-string assembly is capable of creating sufficient pressure to reciprocate the reciprocating shaft 52 axially within the linear upper portion 46 of the guide 44. The reciprocating action of the reciprocating shaft 52 generates an axial percussive force within the guide 44 whereby the reciprocating shaft 52 is capable of imparting a percussive force on the drainage device 16.

While in the preferred embodiment shown in FIG. 2 the percussive assembly 23 is a hammer 56 pneumatically driven, it should also be appreciated that a percussive force generated by the percussive or propulsion assembly may be generated by other devices such as a bumper sub, air actuated hammer, fluid actuated hammer, hydraulic jack assembly, or manual hammer.

As seen in FIG. 2, the disc assembly 24 preferably comprises a plurality of discs 66 stacked together within the guide 44. The disc assembly 24 has an uphole end 68 and a downhole end 70.

Each disc 66 in the disc assembly 24 is positioned and adapted to receive and transmit the percussive force generated by the percussive assembly 23 and to conduct fluid therethrough. The uphole end 68 of the disc assembly 24 receives the percussive force from the downhole end 54 of the reciprocating shaft 52 and transmits the force through the disc assembly 24 to the drainage device 16. The downhole end 70 of the disc assembly 24 is adapted to percussively impact the drainage device 16 whereby the drainage device 16 and usually some of the disks behind it are forced out an opening 71 in the housing 22 and into the subterranean formation 13. A shear pin (not shown) across opening 71 may be used to keep the discs 66 in place until the discs are pushed through the opening 71. Thus, fluid can flow through the drainage device and the exposed disks up through the guide 44 and the borehole.

Because of the size and shape of the discs 66, the discs 66 are capable of moving from the linear upper portion 46 around the curved middle portion 50 and through the directional downhole portion 48 of the guide 44. When stacked together to form a disc assembly 24 as shown in FIG. 2, the discs 66 are capable of extending the entire length of the guide 44. Furthermore, the discs 66 are capable of moving through the entire length of the guide 44 and negotiating any turns or curves in the guide 44.

As shown in FIG. 2, the disc assembly 24 comprises a plurality of discs 66. It should be understood, however, that the number of discs 66 used in the disc assembly 24 may vary. To accommodate various factors, such as the size of the guide and the desired depth of the object, the overall length of the disc assembly may be varied, as long as the percussive force is transferable through the guide to the object.

It should be appreciated that the number of discs may be increased to push the object a distance further into the sidewall 17 of the wellbore 12 and into the subterranean formation 13. The discs 66 are capable of entering the subterranean formation 13 with the object whereby the object is percussively impacted beyond the wellbore 12 and forced further into the subterranean formation 13. Discs 66 may be added into the guide 44 during operation to increase the overall length of the disc assembly 24. Alternatively, the discs 66 may be removed to shorten the overall length of the disc assembly 24.

Figure 6:
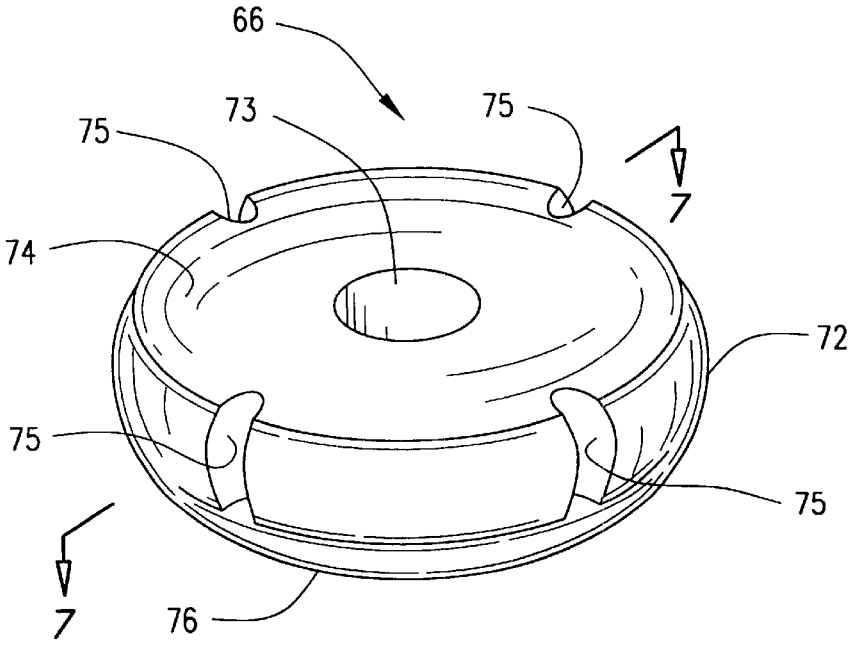
FIG. 6 shows a perspective view of a disc forming part of the disc assembly shown in FIG. 2.
Figure 7:
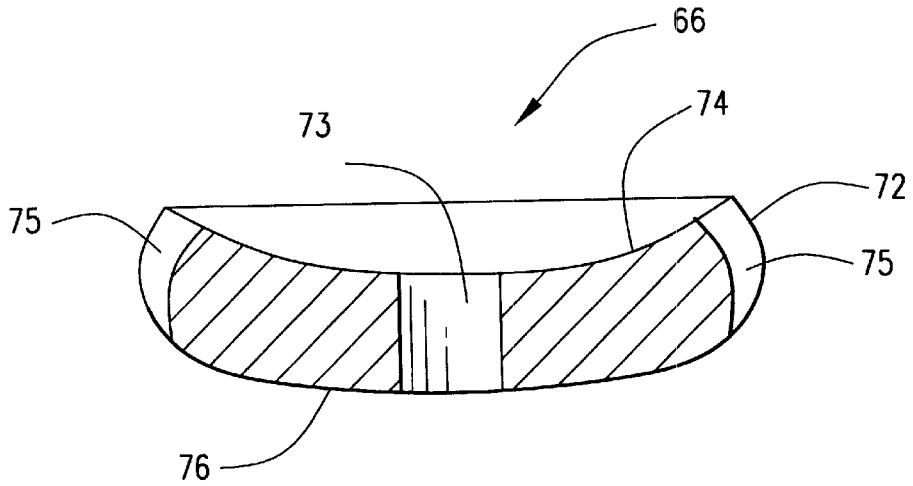
FIG. 7 shows a partially sectional view of the disc of FIG. 6 taken along line 7—7 in FIG. 6.

Referring now to FIGS. 6 and 7, the discs 66 are generally cylindrical with an outwardly curved sidewall 72, configured with a concave upper surface 74 and a convex lower surface 76 so that, in the nested position, the upper surface 74 and the lower surface 76 of each disc 66 have a radius capable of allowing for lateral sliding movement. Additionally, the discs 66 preferably have a hole 73 therethrough and a plurality of channels 75 in the sidewall 72 to permit the flow of fluids up through the guide 44 during operation.

It will be appreciated that while the discs depicted in FIGS. 6 and 7 have concave bodies, the discs may be of a variety of shapes and sizes in accordance with the present invention.

The sidewall 72 of the disc 66 is depicted in FIG. 6 as having generally rounded sidewall 72. The disc 66 is preferably made of metallized aluminum. However, it should also be appreciated that any material that is strong and resilient enough to transmit the percussive force generated by the apparatus 10 so as to drive an object a distance into the side of a wellbore could be used. Such materials include metal, steel, plastic, and combinations thereof.

Referring again to FIG. 2, the object preferably is a drainage device 16 adapted to be percussively impacted by the percussive assembly 23 and driven through the wellbore 12 into the subterranean formation 13. Shown in more detail in FIG. 8, the drainage device 16 is preferably hollow and generally cylindrical having a first end 78, a second end 80, and a bit 82 disposed on the first end 78.

Figure 8:
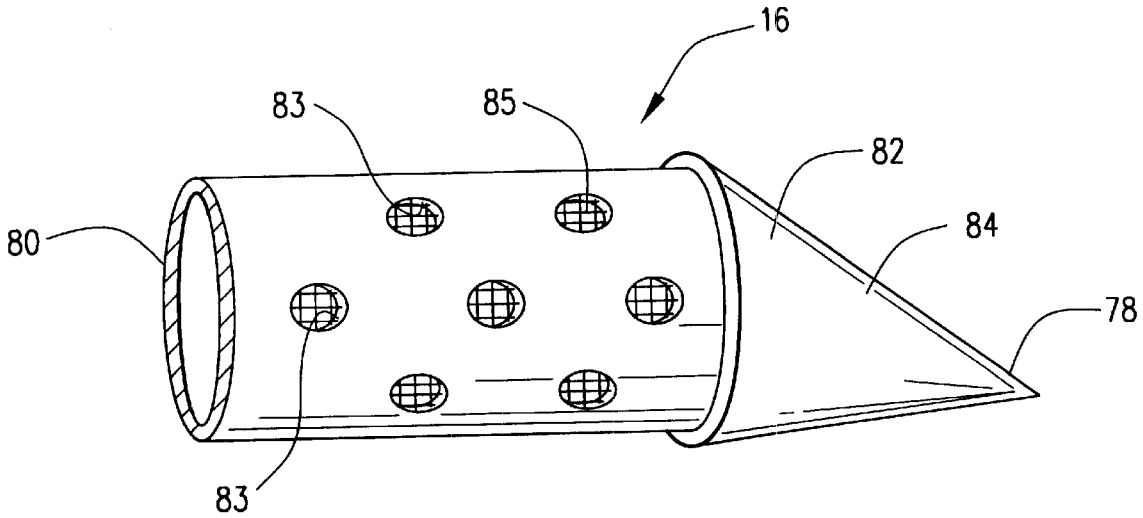
FIG. 8 shows a perspective view of the drainage device of FIG. 2 wherein the drainage device is a perforated shaft.
Figure 8:
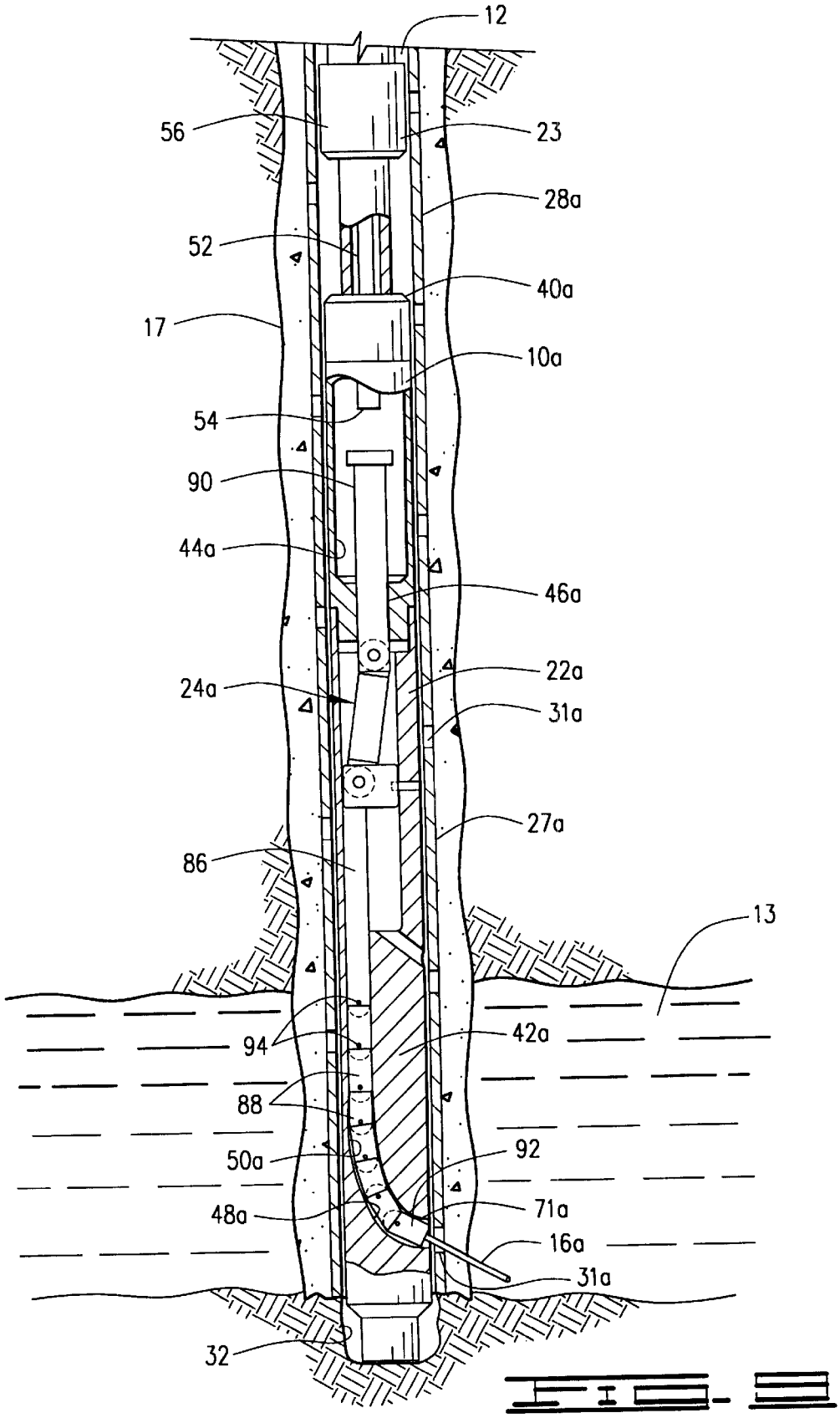

The second end 80 is positionable near the disc assembly 24 and is adapted to receive a percussive force. The bit 82 has a tapered head 84 and may define a cutting element adapted to penetrate the earth. The bit 82 has a diameter larger than the diameter of the second end 80 of the object. In the embodiment of FIG. 8, the tapered head 84 of the bit 82 defines an inclined plane with a leading edge adapted to steer the object as it is driven into the subterranean formation 13.

Figure 27:
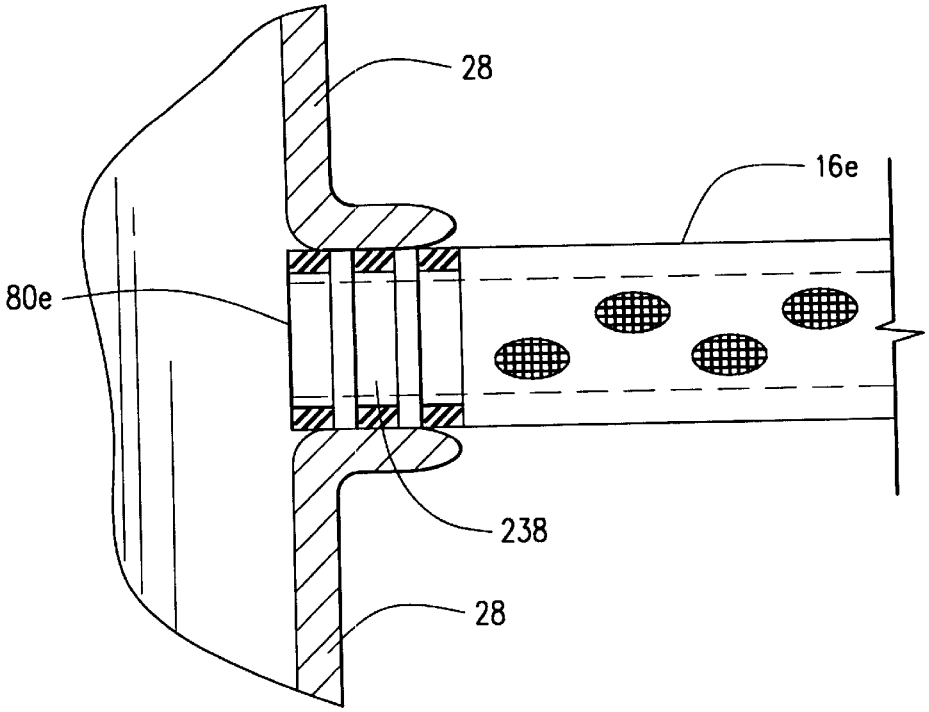
FIG. 27 is a side elevational, fragmented, partially sectional view of a drainage device of FIG. 22B being driven through the casing and into the subterranean formation.
Figure 28:
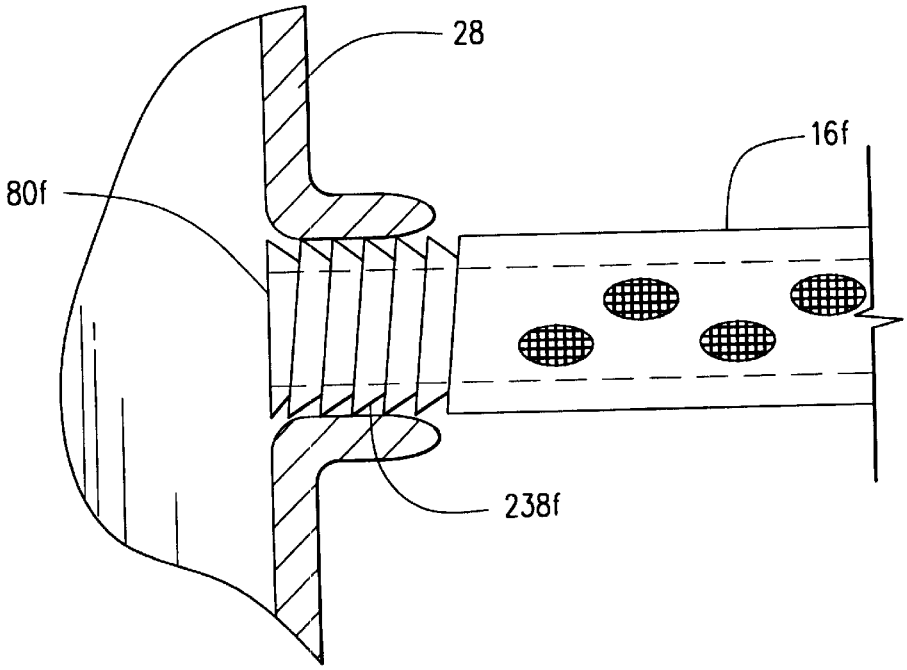
FIG. 28 shows another embodiment of the drainage device of FIG. 27 having a plurality of teeth.

The drainage device may be made of a variety of shapes and sizes and provided with various functional devices. For example, the drainage devices of FIGS. 2, 8 and 19 are generally cylindrical with tapered front ends. However, it will be appreciated that a variety of shapes may be employed, such as the fins of FIGS. 11, 13, 14 and 15 or the discs provided with a tapered head capable of puncturing the casing as depicted in FIG. 21B. Additionally, the drainage device may be provided with resistors which restrict the removal of the drainage device and seal the sidewall of the borehole disposed near the second end of the drainage device as seen in FIGS. 27 and 28. Alternately, in some instances, a core sampler, such as the sampler of FIG. 9, will be used instead of the drainage devices.

Referring still to FIG. 8, the drainage device 16 is capable of forming a hole in the wellbore 12, thereby increasing the effective diameter of the wellbore 12. The drainage device 16 has a plurality of apertures 83 therethrough, and is provided with a sand screen 85 corresponding to the apertures 83. The sand screen 85, located within the drainage device 16, screens the hydrocarbons as they flow into the wellbore 12. The drainage device may be provided with a variety of sizes, shapes, and features to aid in the operation of the device. For example, the drainage device may have a variety of leading edges, filters, screens, liners, bits, and other attributes. The drainage device 16 of FIGS. 2 and 8 is preferably adapted to remain in the subterranean formation.

Turning again to FIG. 2, the use of the apparatus will be described. In operation, the apparatus 10 is lowered via a hoist to the desired location in the wellbore 12. The apparatus 10 is locked into position via the anchor 26. Once in position, the lock assembly 36, securing the percussive assembly 23, is released so that the reciprocating shaft 52 is free to move.

The three string assembly 58 is then activated to create pressure within the hammer 56. The pressure build up in the hammer 56 causes the reciprocating shaft 52 to axially reciprocate within the housing 22. As the reciprocating shaft 52 moves, a percussive force is generated. The reciprocating shaft 52 repeatedly impacts the uphole end 68 of the disc assembly 24. The disc assembly 24 is forced through the guide 44 towards the opening 71 in the housing 22.

The percussive impact generated by the percussive assembly 23 is transferred through each disc 66 of the disc assembly 24 to the drainage shaft 16. As the discs 66 are pounded by the reciprocating shaft 52, the downhole end 70 of the disc assembly 24 impacts the drainage shaft 16. The discs 66 and the drainage shaft 16 are forced through the guide 44 and out the opening 71 in the housing 22. The drainage shaft 16 is then forced through the casing 28, the concrete 30, the sidewall 17 of the wellbore 12 and into the surrounding formation 13, whereby the effective diameter of the wellbore 12 is increased.

The operation continues until the drainage device 16 is extended the desired distance into the subterranean formation 13. Additional discs may be added to force the drainage device further into the subterranean formation. Upon completion, the percussive assembly may be re-secured into the apparatus via the locking assembly 36. The apparatus 10 may then be rotated to release the anchor 26 and the hoist may be used to remove the apparatus 10 from the wellbore 12.

FIG. 9 shows a second embodiment of the present invention. The apparatus 10*a* is disposed within wellbore 12 having a casing 28*a* therein. The apparatus 10*a* preferably comprises a housing 22*a* movably positionable within the wellbore 12, a propulsion assembly such as percussive assembly 23 capable of imparting a percussive force, an anvil assembly such as linkage assembly 24*a* capable of transmitting the percussive force, and a sampler 16*a*.

Figure 10:
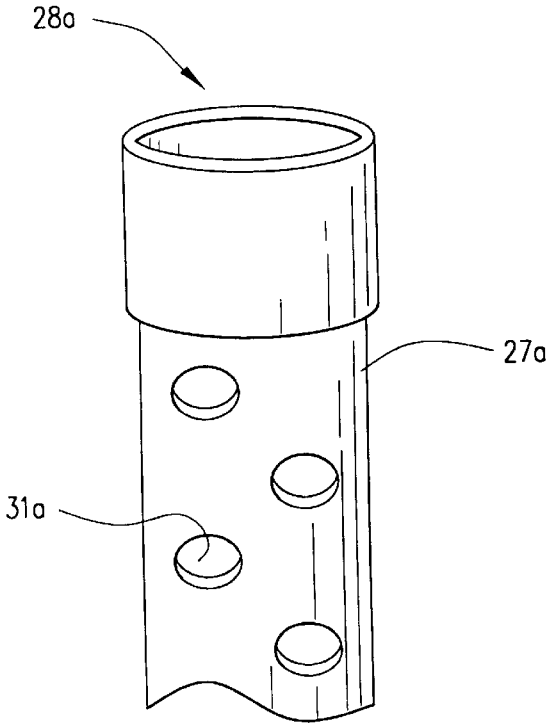
FIG. 10 shows a side perspective view of the upper portion of the casing of FIG. 9.

The casing 28*a* is more particularly shown in FIG. 10. The casing 28*a* comprises a sidewall 27*a* having a plurality of apertures 31*a* therethrough. It should be understood that the apparatus 10*a* may be adapted for use with any casing disposed inside the wellbore 12, such as a casing without apertures as depicted in FIG. 2. When used in conjunction with the casing 28*a,* the sampler 16*a* may be positioned to penetrate the sidewall 17 of the wellbore 12 through the apertures 31*a* thereby reducing the amount of force required to puncture the wellbore 12.

Referring back to FIG. 9, the housing 22*a* preferably comprises an uphole portion 40*a* and a downhole portion 42*a* having a guide 44*a* therethrough. The uphole portion 40*a* preferably is adapted to receive and support the percussive assembly 23 and at least a portion of the linkage assembly 24*a*. The downhole portion 42*a* preferably is threadably connected to the uphole portion 40*a* of the housing 22*a*. Alternatively, the downhole portion 42*a* may be formed integrally with the uphole portion 40*a* of the housing 22*a,* as shown in FIG. 2. The downhole portion 42*a* of the housing 22*a* is adapted to receive and support the remainder of the linkage assembly 24*a* and the sampler 16*a* in the desired orientation.

The guide 44*a* of FIG. 9 is preferably provided with a generally linear uphole portion 46*a,* a directional downhole portion 48*a* and a generally curved middle portion 50*a* therebetween. As stated previously with respect to guide 44 of the embodiment shown in FIG. 2, the guide 44*a* of the embodiment of FIG. 9 may be of any size and shape consistent with the intended purpose and environment of the present invention. The guide 44*a* may be modified as described previously.

In FIG. 9, the guide 44*a* is configured to support the percussive assembly 23, the linkage assembly 24*a* and the sampler 16*a* in the desired orientation during operation thereby directing the movement of the linkage assembly 24*a* and the sampler 16*a* along the desired path. The guide 44*a* terminates at an opening 71*a* in the housing 22*a*. It is preferable to position the opening 71*a* of the housing 22*a* adjacent an aperture 31*a* in the casing 28*a* so that the sampler 16*a* may be extended therethrough without penetrating the sidewall 27*a* of the casing 28*a*.

As seen in the embodiment depicted in FIG. 9, the angle between the linear upper portion 46*a* and the directional downhole portion 48*a* of the guide 44*a* is approximately 120 degrees thereby creating a 120 degree exit angle for the sampler 16*a*.

The percussive assembly 23 of FIG. 9 is the same percussive assembly employed in the embodiment of FIG. 2, previously described herein. The percussive assembly 23 comprises a reciprocating shaft 52 terminating in a downhole percussive end 54, a hammer 56, and a string assembly 58 (FIG. 2). The percussive assembly 23 is disposed in the uphole portion 40*a* of the housing 22*a* and is adapted to impart a percussive force to the linkage assembly 24*a*.

The linkage assembly 24*a* comprises a plurality of interconnected linkages 88 adapted to accept and transmit the percussive force generated by the percussive assembly 23. The linkages 88 are generally linear, pivotally connected shafts capable of receiving and transmitting a percussive force. The preferred linkage assembly 24*a* further comprises a first linkage 90 adapted to contact the downhole percussive end 54 of the reciprocating shaft 52 and a last linkage 92 connected to the sampler 16*a*.

The linkages 88 are joined together via pin joints 94 to form a chain within the guide 44*a*. The pin joints 94 permit the linkages 88 to move two dimensionally within the guide 44*a*. However, it should be understood that other joints may be used to interconnect the linkages 88, such as rotary joints, u-joints, and other joints which permit the linkage assembly 24*a* to move through the guide 44*a* and force the sampler 16*a* into the subterranean formation 13 consistent with this invention.

Because of the number of linkages 88 and the flexible motion of the pin joints 94 connecting the linkages 88, the linkages 88 are capable of extending from the linear upper portion 46*a,* around the curved middle portion 50*a* and through the directional downhole portion 48*a* of the guide 44*a*.

The first linkage 90 is preferably supported within the linear upper portion 46*a* of the housing 22*a*. The linear upper portion 46*a* of the guide 44*a* preferably permits the first linkage 90 to move axially through the housing 22*a* as the linkage assembly 24*a* is impacted by the percussive assembly 23.

Each subsequent linkage 88 is adapted to conform to the size, shape and orientation of the guide 44*a*. As shown in FIG. 9, the linkages 88 are provided with various lengths to negotiate the curves and conform to the structure of the guide 44*a*. The linkages 88 of FIG. 9 preferably are provided with shorter lengths to negotiate the sharper curved portions of the guide. Linkages with longer lengths are provided to bridge between generally unsupported portions of the guide. However, it will be appreciated that any length and shape of linkages may be utilized as long as the linkage assembly 88 is capable of transmitting the percussive force from the percussive assembly 23 to the sampler 16*a* and forcing the sampler 16*a* through the sidewall 17 of the wellbore 12.

The object penetrating the sidewall 17 of the wellbore 12, as depicted in FIG. 9, is a sampler 16*a* having a generally tubular body adapted to receive a core sample from the subterranean formation 13. The linkage assembly 24*a* receives the percussive impact from the percussive assembly 23 and transfers the force through the plurality of linkages 88 to last linkage 92 and to the sampler 16*a*. The sampler 16*a* is driven into the sidewall 17 of the wellbore 12 through an aperture 31*a* in the casing 28*a*.

The linkages 88 may be extended into the subterranean formation 13 and retracted therefrom. Because the sampler 16*a* is interconnected to the plurality of linkages 88, the linkage assembly 24*a* and the sampler 16*a* are retractable from the subterranean formation 13. As the linkages 88 are retracted, the sampler 16*a* is pulled out of the subterranean formation 13 and back into the housing 22*a* through the opening 71*a* in the housing 22*a*.

In the embodiment of FIG. 9, the object is a sampling device 16*a* such as a core sampler connected to the linkage assembly 24*a*. However, it should be understood that any object may be utilized in accordance with this invention. Additionally, the object may be connected to the linkage assembly 24*a* as in FIG. 9 or separate as shown in FIG. 2.

In operation, the apparatus 10*a* is lowered via a hoist (not shown) to the bottom 32 of the wellbore 12. The apparatus 10*a* rests in place on the bottom 32 of the wellbore 12 and is positioned so that opening 71*a* is adjacent an aperture 31*a*. The three string assembly 58 is then activated to create pressure within the hammer 56. The pressure build up in the hammer 56 causes the reciprocating shaft 52 to axially reciprocate within the housing 22*a*. As the reciprocating shaft 52 moves, a percussive force is generated. The reciprocating shaft 52 repeatedly impacts the first linkage 90 of the linkage assembly 24*a*. The linkage assembly 24*a* is forced through the guide 44*a* towards the opening 71*a* in the housing 22*a*.

The percussive impact is transferred through each linkage 88 in the linkage assembly 24*a* to the sampler 16*a*. The percussive force pounds the linkages 88 through the guide 44*a* and towards the opening 71*a* in the housing 22*a*. As the linkages 88 are pounded by the reciprocating shaft 52, the last linkage 92 in the linkage assembly 24*a* forces the sampler 16*a* through the guide 44*a* and out the opening 71*a* in the housing 22*a*. The sampler 16*a* is then forced through apertures 31*a* of the casing 28*a* and through the concrete 30, the sidewall 17 of the wellbore 12 and into the surrounding formation 13.

The operation continues until the sampler 16*a* is extended the desired distance into the subterranean formation 13. Linkages may be added or removed to adjust the length of the linkage assembly and the distance the sampler 16*a* is extended into the subterranean formation. Upon completion, the hoist may then be used to remove the linkage assembly 24*a* and the core sampler 16*a* from the subterranean formation 13 and the apparatus 10*a* from the wellbore 12. The linkage assembly 24*a* is pulled uphole through the housing 22*a* with the sampler 16*a,* and the core sample is recovered.

Referring now to FIG. 11 is a third embodiment of the apparatus employed in a system for increasing the effective diameter of a wellbore 12. The system comprises an apparatus 10*b* disposable in a pre-loaded casing 28*b*.

The apparatus 10*b* is shown inside a wellbore 12 having a pre-loaded casing 28*b* therein. The apparatus 10*b* is adapted to impart a percussive force on adrainage devices 16*b* loaded into a pre-loaded casing 28*b* whereby the drainage devices are driven through the sidewall 17 of the wellbore 12 and into the subterranean formation 13.

Figure 12:
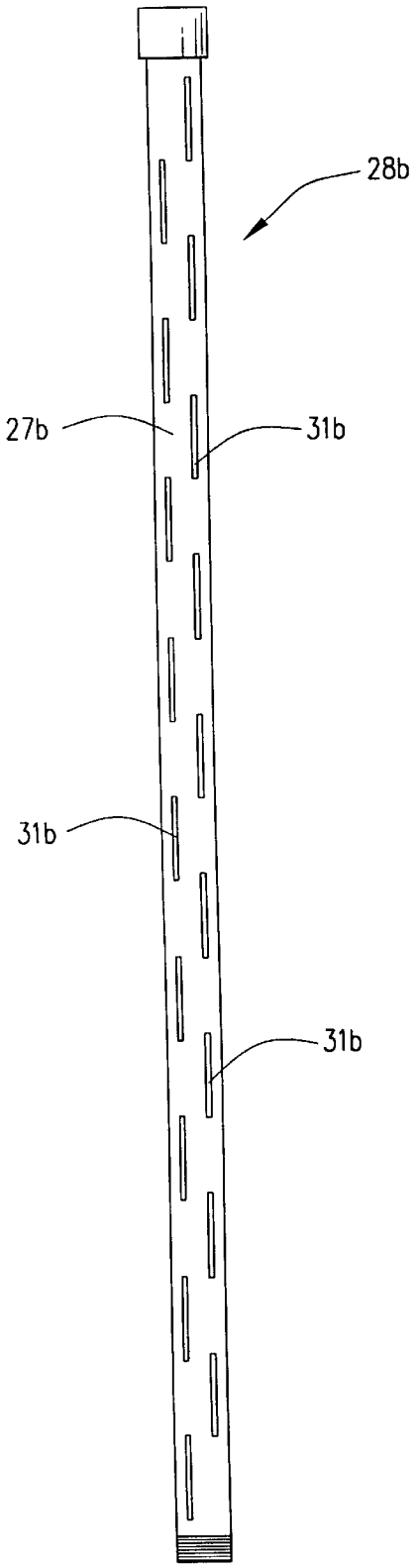
FIG. 12 shows a side elevational view of the upper portion of a pre-loaded casing of FIG. 11 with the drainage devices pre-loaded in the casing.
Figure 13:
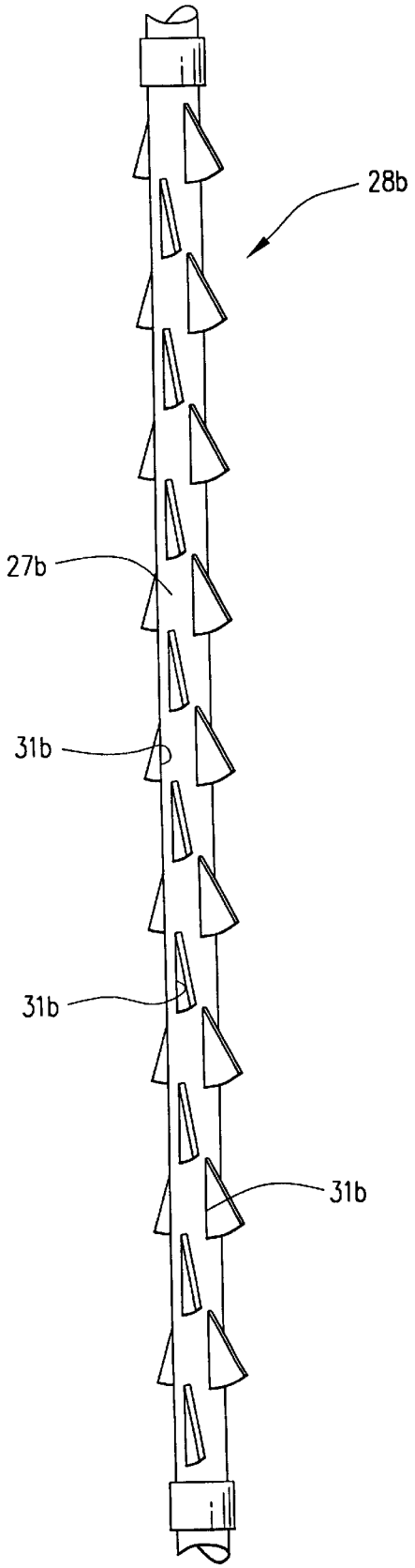
FIG. 13 shows a side elevational view of the upper portion of the pre-loaded casing of FIG. 12 with the drainage devices extending therethrough.
Figure 1E:
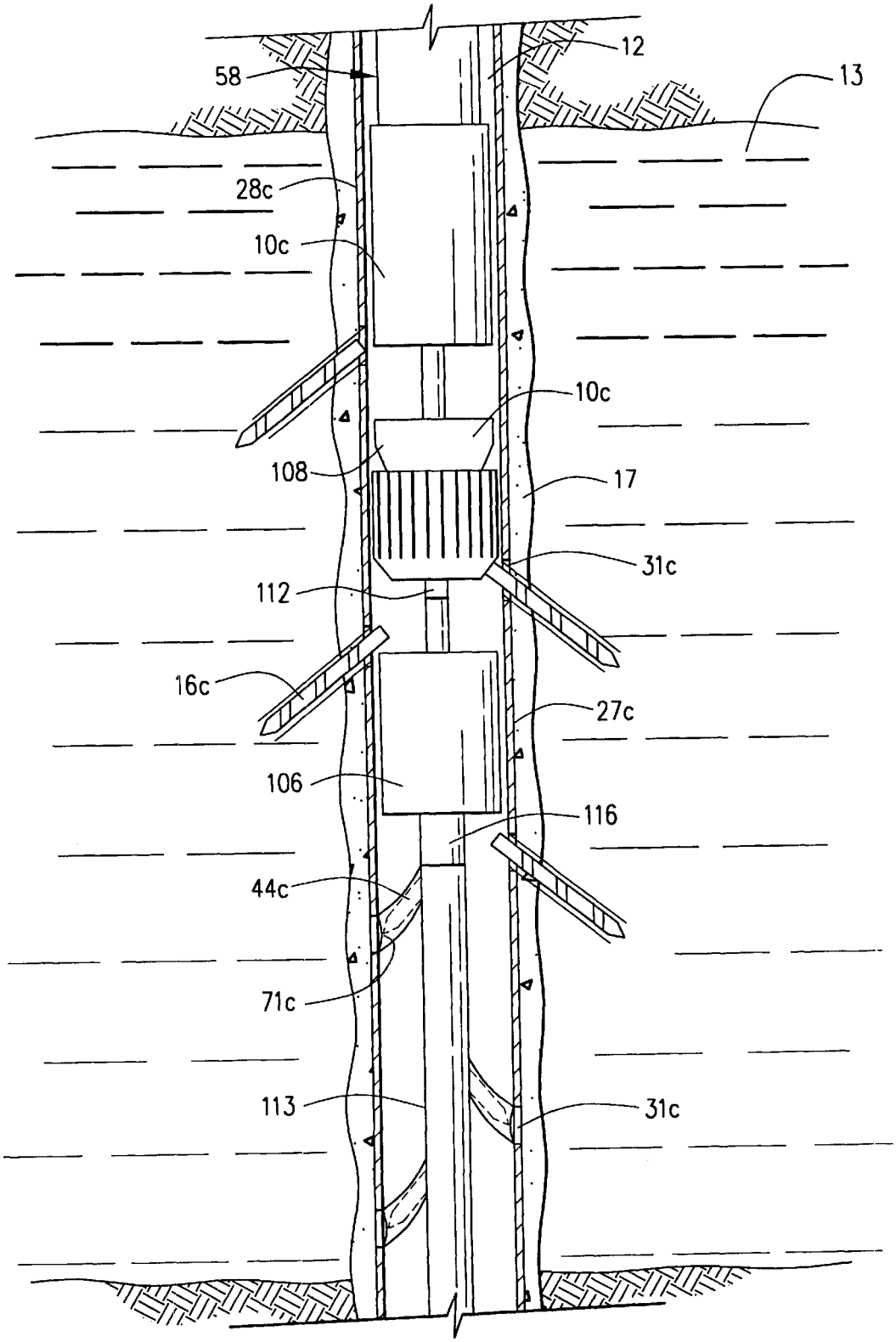

As seen in greater detail in FIGS. 12 and 13, the pre-loaded casing 28*b* preferably comprises a tubular sidewall 27*b* having a plurality of apertures 31*b* therethrough and drainage devices 16*b* disposed in each aperture 31*b*. While the FIGS. 11, 12 and 13 depict drainage devices 16*b* loaded into the pre-loaded casing 28*b,* it should be understood that many objects consistent with this invention may be loaded into the casing and/or extended therethrough using the percussive force.

Figure 15:
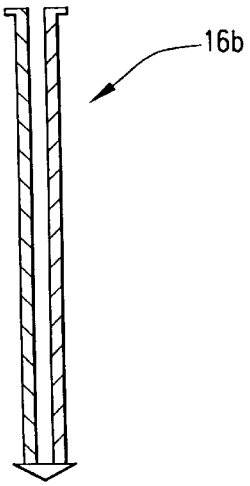
FIG. 15 shows a cross sectional view of the drainage device of FIG. 14.
Figure 14:
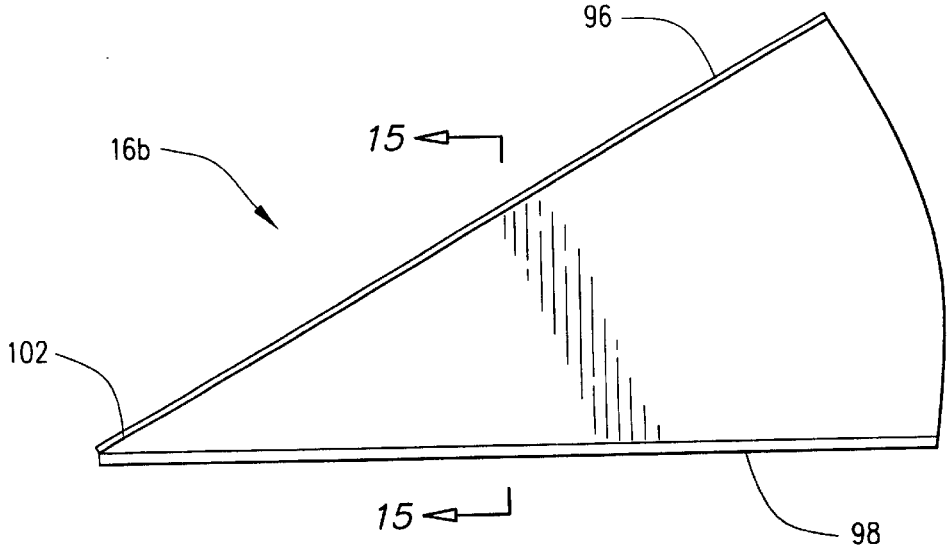
FIG. 14 shows a side elevational view of the drainage device of FIG. 13.
Figure 1:
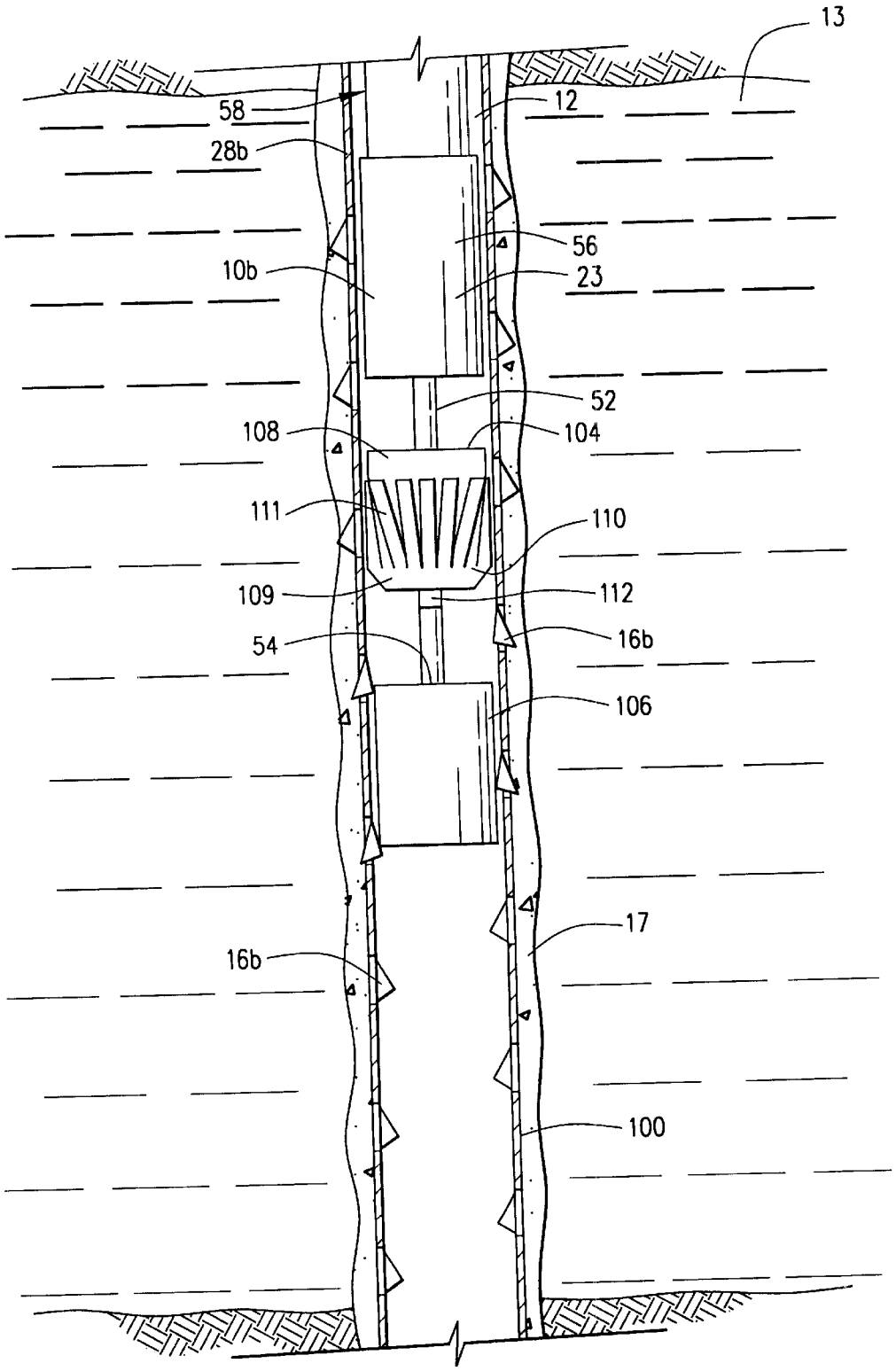

The drainage devices 16*b* of FIG. 11 are shown in detail in FIGS. 14 and 15. The drainage devices 16*b* are generally triangular shaped fins having an outer edge 96, an inner edge 98 and generally linear and hollow cross-section. The drainage devices 16*b* are positioned within the apertures 31*b* in the sidewall 27*b* of the casing 28*b* and extend a distance inside the casing 28*b*.

The drainage devices 16*b* are disposed inside the casing 28*b* with the outer edge 96 of the drainage devices 16*b* adjacent the outer surface 100 of the casing 28*b* thereby permitting the casing 28*b* to be inserted into the wellbore 12 without additional resistance. The tips 102 (FIG. 14) of the drainage devices 16*b* are attached to the casing 28*b,* so the drainage devices 16*b* may be extended through the casing 28*b* and remain attached thereto.

Referring back to FIG. 11, the apparatus 10*b* preferably comprises an anvil assembly such as percussive assembly 23, and a hole opener 104. The percussive assembly 23 is the same percussive assembly used in the embodiments depicted in FIGS. 2 and 9. However, in FIG. 11, the reciprocating shaft 52 is provided with a bit 106 removably attached to the downhole end 54 of the reciprocating shaft 52. The hole opener 104 is attached to the reciprocating shaft 52 a distance uphole from the bit 106.

The bit 106 preferably has a generally solid, cylindrical body connected to the downhole end 54 of the reciprocating shaft 52. The bit 106 is reciprocated with the reciprocating shaft 52 as the reciprocating shaft 52 moves axially under the pressure of the hammer 56. The bit 106 is adapted to fit inside the casing 28*b* and impact the drainage devices 16*b* whereby the drainage devices 16*b* are driven through the casing 28*b* and into the subterranean formation 13.

The hole opener 104 preferably is connected to the shaft 52 of the hammer 56 between the hammer 56 and the bit 106. The hole opener 104 comprises a first portion 108 and a second portion 109. The first portion 108 defines a solid frusto-conical body connected to the reciprocating shaft. The second portion 109 defines a generally hollow cylindrical body portion adapted to receive and conform to the first portion 108. The second portion 108 has a sidewall 110 that is cut into a plurality of fingers 111 so that when the first portion 108 is inserted inside the second portion 109, the second portion 109 conforms to the shape of the first portion 108 and the fingers 111 extend radially about the first portion 108.

The first portion 108 is fixed on the reciprocating shaft 52. However, the second portion is free to move along the reciprocating shaft 52 between the first portion 108 and a collar 112. The collar 112 is fixed to the reciprocating shaft 52 a distance downhole from the first portion 108.

When the second portion 109 engages an obstruction in the wellbore 12, such as the drainage device 16*b*, and the apparatus 10*b* is moved downhole, the second portion 109 is frictionally engaged and prevented from moving further downhole. The first portion 108 continues to move downhole towards the second portion 109. As the first portion 108 contacts the second portion 109, the fingers 111 expand radially about the reciprocating shaft 52 and press against the sidewall 17 of the wellbore 12. In the expanded position, the fingers 111 push against the sidewall 17 of the wellbore 12 and impact the drainage devices 16*b* thereby driving them a distance further into the sidewall 17 of the wellbore 12.

Once the drainage device 16*b* is pushed into the sidewall 17 of the wellbore 12, the second portion 109 of the hole opener 104 is free to move away from the first portion 108 and gravitationally fall towards the collar 112. Once the second portion 109 loses contact with the first portion 108, the fingers 111 return to the original, collapsed position. In the collapsed position the hole opener 104 may now move freely within the wellbore 12.

Referring still to FIG. 11, in the contracted position, the fingers 111 are retracted, and the hole opener 104 is easily movable within the wellbore 12. In the expanded position, the fingers 111 effectively increase the overall diameter of the hole opener 104. The expansion of the fingers 111 within the wellbore 12 imparts a radial percussive force from the hole opener 104 to the drainage devices 16*b* within the wellbore 12. As the drainage devices 16*b* are impacted by the fingers 111, they are driven further through the casing 28*b* and into the subterranean formation 13. FIG. 13 shows the drainage devices 16*b* in the expanded position after being driven out.

In operation, the pre-loaded casing 28*b* is inserted into the wellbore 12 with the drainage devices 16*b* extending inside the casing 28*b*, as shown in FIG. 12. Once installed, the apparatus 10*b* may be lowered into the casing 28*b* using a hoist. The hammer 56 is activated and the reciprocating the reciprocating shaft 52 begins to reciprocate thereby reciprocating the bit 106 and the hole opener 104. The bit 106 percussively impacts the drainage devices 16*b*, whereby the drainage devices 16*b* are extended a distance through the apertures 31*b* of the pre-loaded casing 28*b*, as shown in FIG. 13, and into the subterranean formation 13, as shown in FIG. 11. As the bit 106 forces the drainage devices 16*b* into the earth, the bit 106 extends further into the wellbore 12 to impact drainage devices 16*b* located further downhole in the wellbore 12.

As seen in FIG. 11, as the bit 106 drops into the wellbore 12, the hole opener 104 moves downhole into the wellbore 12. As the hole opener 104 drops into the wellbore 12, the second portion 109 of the hole opener 104 rests on a drainage device 16*b*. As the hole opener 104 pushes down on the drainage device 16*b*, the first portion 108 of the hole opener 104 is driven into the second portion 109 of the hole opener 104 whereby the fingers 111 are extended radially about the shaft 52.

As the fingers 111 extend about the shaft 52, the fingers 111 push against the expansion devices 16*b* located in the casing 28*b*. The drainage devices 16*b* are driven a distance further through the casing 28*b* and into the subterranean formation 13. As the hole opener 104 pushes in the drainage device 16*b* through the sidewall of the wellbore, the hole opener 104 pushes past the drainage device 16*b*. Once past the drainage device 16*b*, the second portion 109 of the hole opener 104 is free to move downhole from the first portion 108 of the hole opener. The second portion 109 of the hole opener may then return to its original shape thereby retracting the fingers 111. In this now collapsed state, the hole opener 104 is free to move downhole to the next expansion device 16*b*.

The operation repeats until the desired number of drainage devices 16*b* have passed through the casing 28*b*. Upon completion of the operation, the fingers 111 of the hole opener 104 are retracted so that the apparatus 10*b* may be removed from the wellbore 12.

As best seen in FIG. 11, the drainage devices 16*b* extend through the apertures 31*b* of the casing 28*b*, through the concrete 30, through the sidewall 17 of the wellbore 12, and into the subterranean formation 13. The tips 102 of the drainage devices 16*b* remain connected to the casing 28*b* after being driven into the subterranean formation 13. However, it will be appreciated that the drainage devices 16*b* may be completely or partially released as they are driven through the casing 28*b*. Alternatively, the drainage devices 16*b* may be disposed through the apertures 31*b* of the casing 28*b* without being connected thereto.

Referring now to FIG. 16, another system for increasing the effective diameter of a wellbore is depicted. The system comprises a pre-loaded casing 28*c* and the fourth embodiment of the apparatus.

The apparatus 10*c* is disposed into a wellbore 12 having a pre-loaded casing 28*c* therein. The apparatus 10*c* is adapted to impart a percussive force on drainage devices 16*c* loaded into a pre-loaded casing 28*c*, whereby the drainage devices 16*c* are driven through the sidewall 17 of the wellbore 12 and into the subterranean formation 13.

Figure 17:
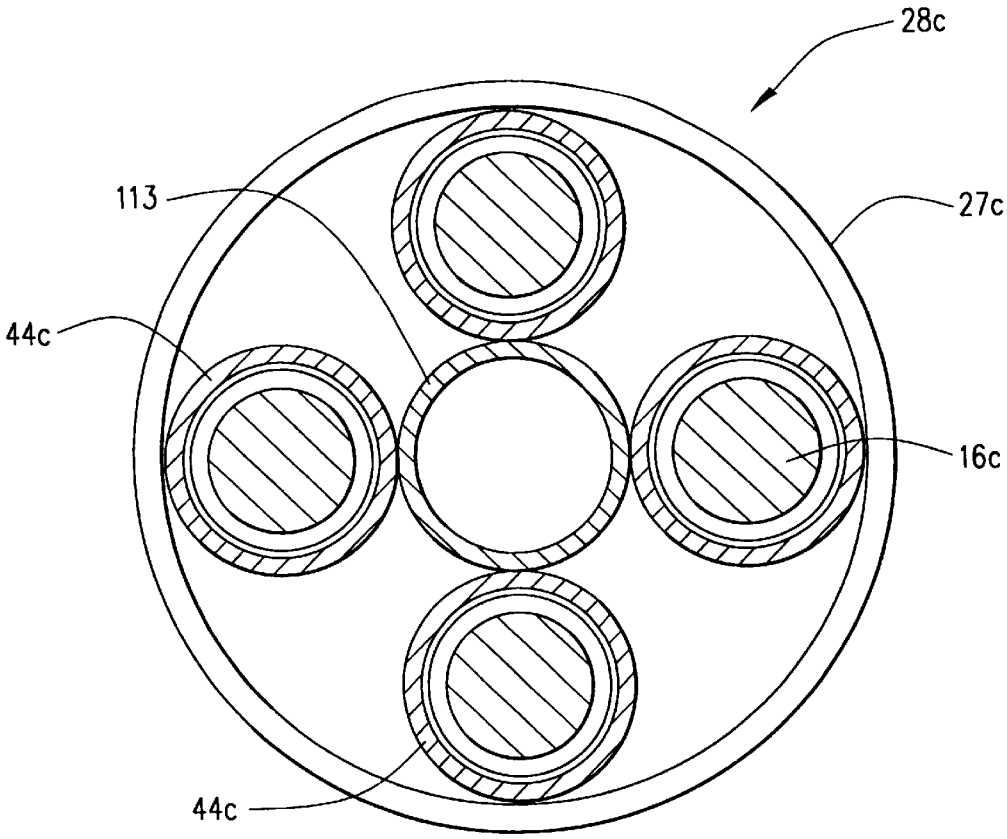
FIG. 17 shows an end view of the pre-loaded casing of FIG. 16 showing cylindrical drainage devices and tubing for pumping cement to complete the well.
Figure 18:
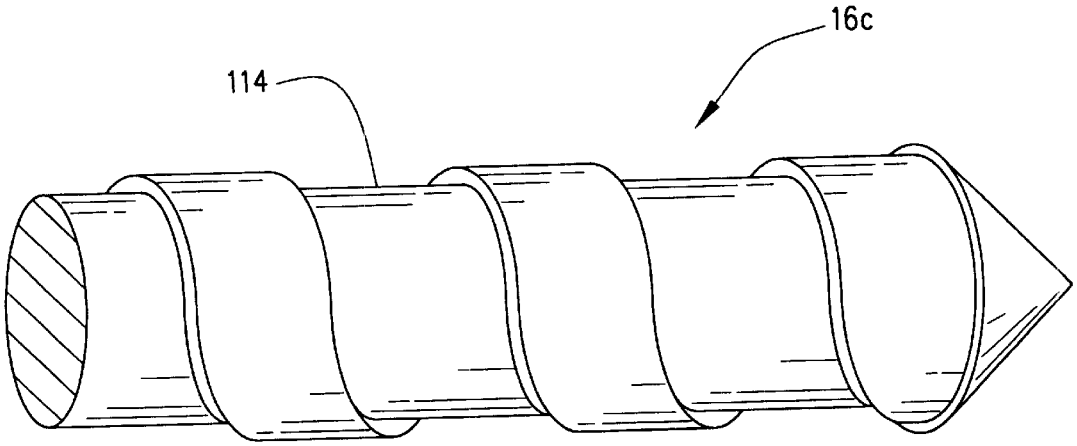
FIG. 18 shows a side elevational view of the pre-loaded casing of FIG. 17 with the tubing and cylindrical drainage devices depicted by dotted lines.

As seen in FIGS. 17 and 18, the pre-loaded casing 28*c* preferably comprises a tubular sidewall 27*c*, an internal tube 113, a plurality of releasable guides 44*c*, and a drainage device 16*c* (FIG. 16) disposed in each guide 44*c*. The drainage devices 16*c* are positioned within the guides 44*c* adjacent the sidewall 27*c* of the casing 28*c* between the sidewall 27*c* and the internal tube 113.

The guides 44*c*, as shown in FIGS. 17 and 18, preferably comprise generally linear tubes extending from a generally linear uphole portion 46*c* and through a directional downhole portion 48*c*. Each guide 44*c* terminates in an opening 71*c* in the casing 28*c*. The shape of the guide 44*c* is adapted to hold the drainage device 16*c* in place during operation. The guide 44*c* retains the drainage device 16*c* within the casing 28*c* in the proper orientation for release. The guides 44*c* are releasable from the sidewall 17 of the casing 28*c* into the subterranean formation 13 with the drainage device 16*c* therein.

Referring still to FIGS. 16 and 18, the casing 28*c* has guides 44*c* at staggered positions in the wellbore 12, so the drainage devices 16*c* may be released into the sidewall 17 of the wellbore 12 at various locations in the wellbore 12. The guides 44*c* are positioned circumferentially about the casing 28*c* so that the drainage devices 16*c* are released at various locations about the wellbore 12. Additionally, the guides 44*c* may be made integral with or separate from the drainage devices 16. It should be noted that any number and shape of guides may be used to hold a number of objects for release into the sidewall of the borehole.

The drainage device 16*c* of FIG. 16 is shown in greater detail in FIG. 19. The drainage device 16*c* defines a solid cylindrical body with a helical channel 114. The helical channel 114 acts as a flow channel aiding in transferring fluid from the subterranean formation 13 to the wellbore 12. The drainage device 16*c* of FIG. 17 may also be provided with a filter (not shown) adapted to minimize the flow of particles from the subterranean formation 13 into the wellbore 12. While FIG. 16 depicts a drainage device 16*c* loaded into the pre-loaded casing 28*c,* it should be understood that many objects, such as the drainage device 16 described herein, may be loaded into the casing 28*c* and/or extended therethrough using the percussive force as described herein.

Referring back to FIG. 16, the apparatus 10*c* is similar to apparatus 10*b,* but preferably further comprises a pipe retriever 116 extending downhole from the bit 106 and removably connected thereto.

Figure 20:
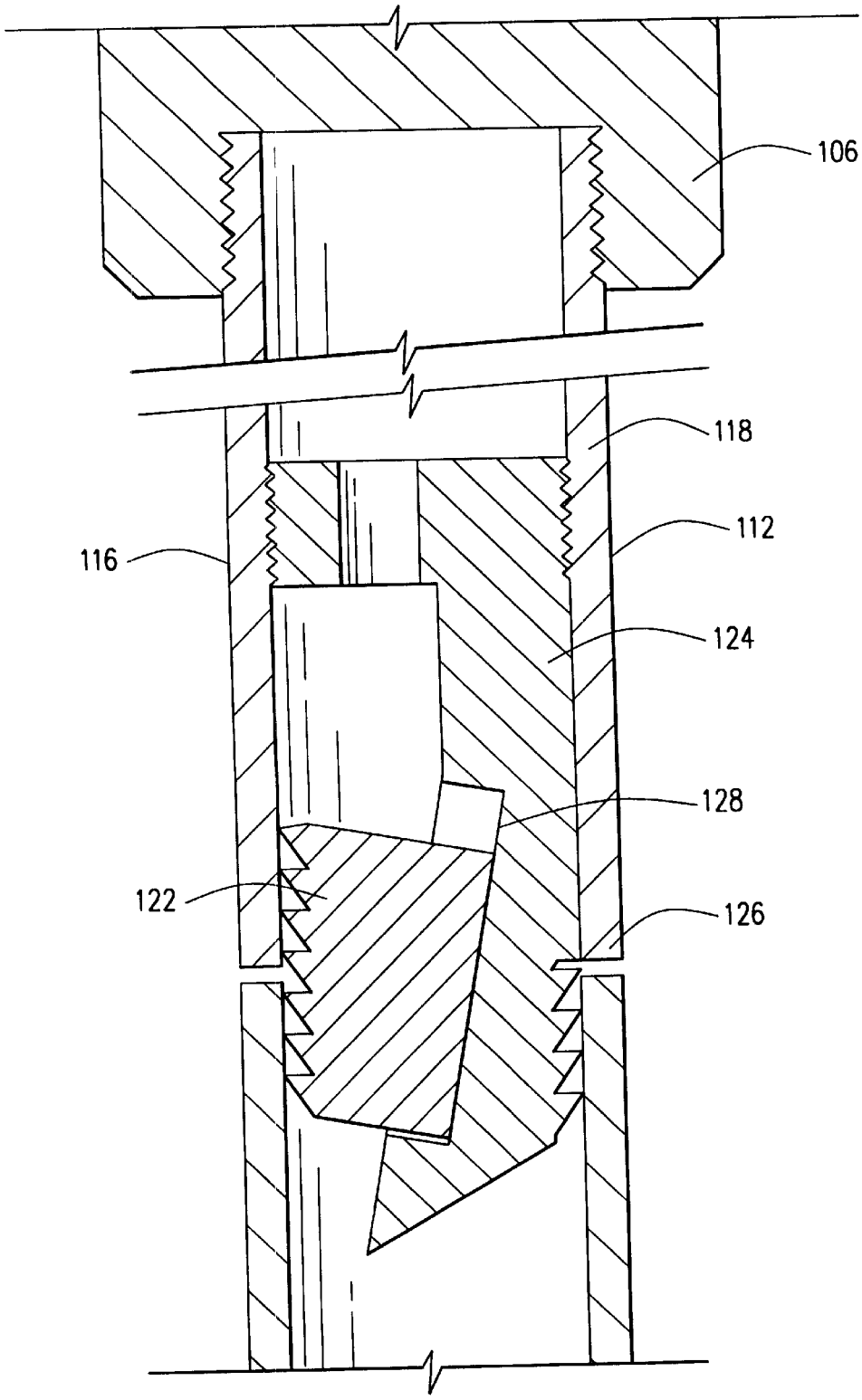
FIG. 20 shows a longitudinal sectional view of the pipe retriever assembly of FIG. 16.

The pipe retriever 116 of FIG. 16 is shown in detail in FIG. 20. The pipe retriever 116 comprises a body portion 118 having a slanted slot therethrough (not shown), a movable slip 122 extending downhole from the body portion 118 and a stationary slip 124 adjacent the movable slip 122 and extending downhole from the body portion 118.

The body portion 118 of the pipe retriever 116 is preferably a hollow cylinder threadably connected to the bit 106 and removable therefrom. The lower end 126 of the body portion 118 is adapted to percussively impact the internal tube 113 and drive it downhole during operation. The body portion 118 has a slanted slot (not shown) angled to guide the movement of the movable slip 122 within the body portion 118. The body portion 118 is adapted to receive and hold the movable slip 122 and the stationary slip 124 during operation.

The movable slip 122 and the stationary slip 124 combine to form a generally cylindrical shape adapted to fit inside the internal tube 113. The stationary slip 124 has a sloped surface 128 adjacent the movable slip 122. The movable slip 122 travels along the sloped surface 128 of the stationary slip 124 and is held in position by the slanted slot.

As the movable slip 122 travels along the sloped surface 128 of the stationary slip 124, the overall width of slips 122 and 124 varies. When the movable slip 122 is in the uphole position, the overall combined width of the slips is minimized making the slips disposable in the internal tube 113. As the pipe retriever 116 is withdrawn from the wellbore 12, the movable slip 122 moves to the downhole position, thereby maximizing the overall width of the slips 122 and 124 and thereby resisting removal from the internal tube 113. As the pipe retriever 116 is lifted uphole, gravity pulls the movable slip 122 to the downhole position thereby securing the slips 122 and 124 inside the internal tube 113. Once secured into position, the slips 122 and 124 grab the internal tube 113, so it is lifted out of the wellbore 12 with the apparatus 10*c*.

In operation, the apparatus 10*c* is lowered into a wellbore 12 having a casing 28*c* therein. The percussive assembly 23 generates a percussive force, which reciprocates the bit 106 and the pipe retriever 116. The pipe retriever 116 percussively impacts the internal tube 113 and drives it downhole into the wellbore 12. The bit 106 percussively impacts the drainage devices 16*c* in the guides 44*c* and drives them through the guides 44*c,* out the openings 71*c* and into the subterranean formation 13. The hole opener 104 then expands to impact the drainage devices 16*c* again and drives them further through the casing 28*c* and into the subterranean formation 13.

Upon completion of the percussion operation, the apparatus 10*c* may be removed from the wellbore 12 by a hoist as previously described herein. The internal tube 113 may simultaneously be removed by inserting the slips 122 and 124 inside the internal tube 113 and retrieving it from the wellbore 12 as heretofore described.

Figure 21A:
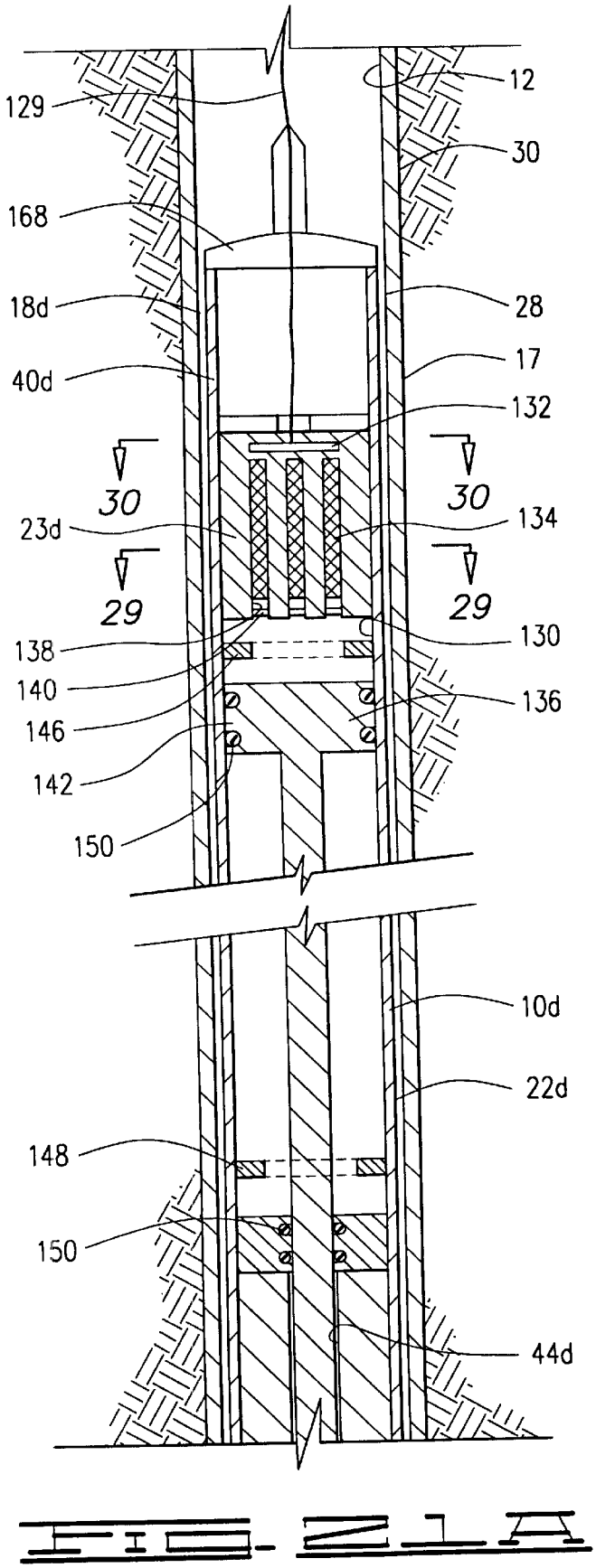
FIG. 21A shows a top portion of a longitudinal sectional view of a fifth embodiment of the present invention comprising an explosive assembly and a disc assembly, used to install a drainage device installed in a wellbore in accordance with the present invention.
Figure 21B:
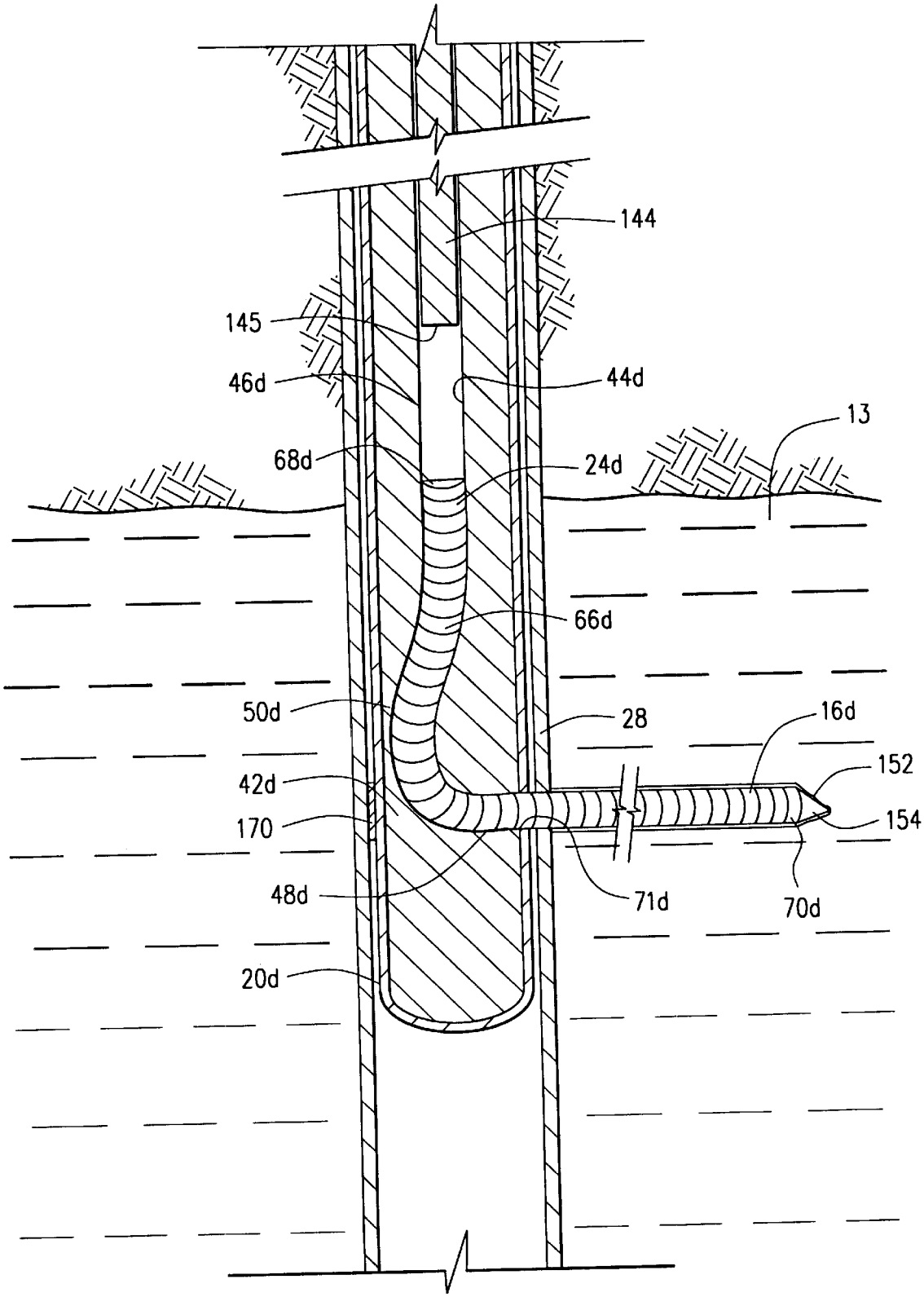
FIG. 21B shows a bottom portion of the longitudinal sectional view of the embodiment of FIG. 21A.

Turning to FIGS. 21A and 21B, a fifth embodiment of the present invention is shown. The apparatus 10*d* is disposed within wellbore 12 having a casing 28 therein. The apparatus 10*d* preferably comprises a housing 22*d* movably positionable within the wellbore 12, a propulsion assembly such as explosive assembly 23*d* capable of imparting an explosive force, and an anvil assembly such as disc assembly 24*d* adapted to receive the explosive force.

Figure 30:
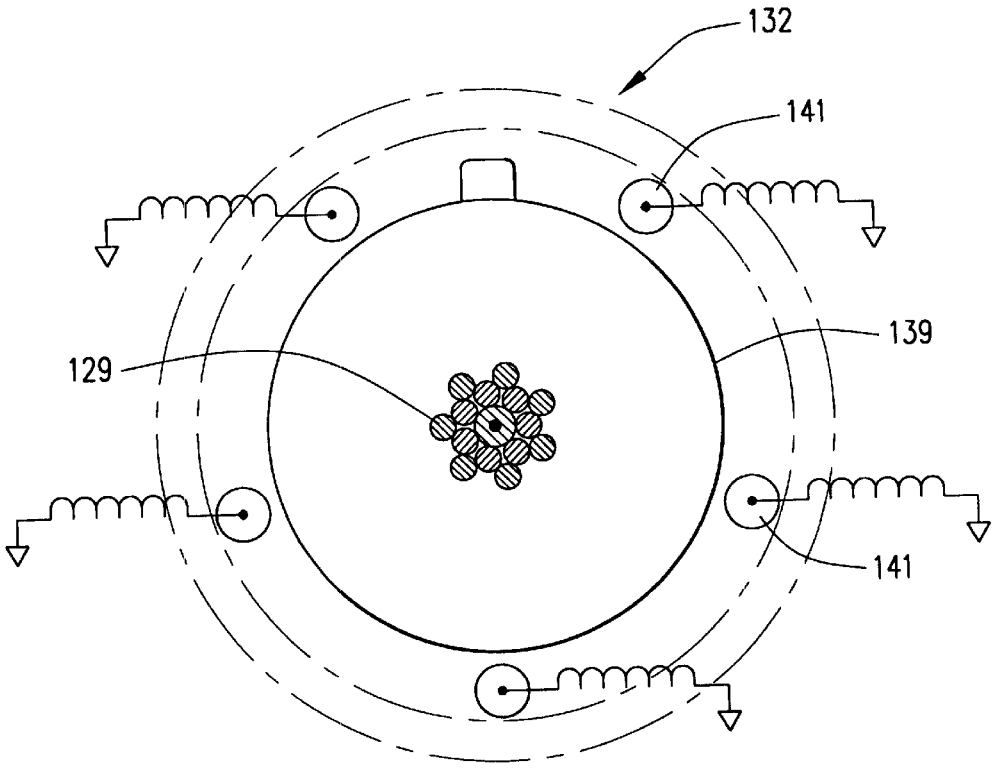
FIG. 30 shows a plan partly schematic view of a pressure sensitive switch and a wire line cable used in the operation of the explosive assembly of FIG. 21A.

The apparatus 10*d* is preferably provided with a wire line cable 129 capable of supporting the apparatus 10*d* as it is lowered into the wellbore 12, and providing electricity to the apparatus 10*d* as necessary to operate various aspects of the apparatus as will be described more fully herein. As best seen in FIG. 30, the wire line cable 129 comprises several wires capable of transferring electricity downhole to the apparatus 10*d* from a power source located uphole (not shown).

Referring back to FIGS. 21A and B, the housing 22*d* of the apparatus 10*d* preferably is generally cylindrical with an uphole portion 40*d* and a downhole portion 42*d*. The uphole portion 40*d* of the housing 22*d* defines a pressurized chamber 130. The downhole portion 42*d* of the housing 22*d* is solid and defines a guide 44*d* therethrough.

With continuing reference to FIGS. 21A and B, the guide 44*d* preferably defines an elongate aperture adapted to hold the disc assembly 24*d* in the proper orientation for release. Similar to the guides shown in FIGS. 2 and 9, the guide 44*d* of FIG. 21B preferably comprises a generally linear upper portion 46*d,* a directional downhole portion 48*d* and a middle portion 50*d* therebetween. The directional downhole portion 48*d* is configured to direct the drainage device 16*d* to the desired location within the subterranean formation 13 and at the desired orientation.

The middle portion 50*d* defines a transition area between the upper portion 46*d* and lower portion 48*d,* and preferably defines an elbow linking the linear upper portion 46*d* to the directional downhole portion 48*d* at a radius sufficient to permit the disc assembly 24*d* to pass through the guide 44*d*.

As stated previously with respect to guides 44 of FIG. 2 and 44*a* of FIG. 9, the shape of the guide 44*d* and the orientation of the directional downhole portion 48*d* determine the angle at which the object exits the guide 44*d* and penetrates the subterranean formation 13. In the embodiment shown in FIGS. 21A and B, the linear portion 46*d* of the guide 44*d* forms a 90 degree angle to the directional downhole portion 48*d,* thereby creating a 90 degree exit angle for the disc assembly 24*d.*

The explosive assembly 23*d* comprises an activator 132, a series of explosive charges 134, and a piston 136. The explosive assembly 23*d* is disposed within the pressurized chamber 130 with the piston 136 extending a distance downhole into the linear upper portion 46*d* of the guide 44*d.* The explosive assembly 23*d* is adapted to increase pressure within the pressurized chamber 130 to drive the piston 136 a distance downhole through the guide 44*d.*

Figure 29:
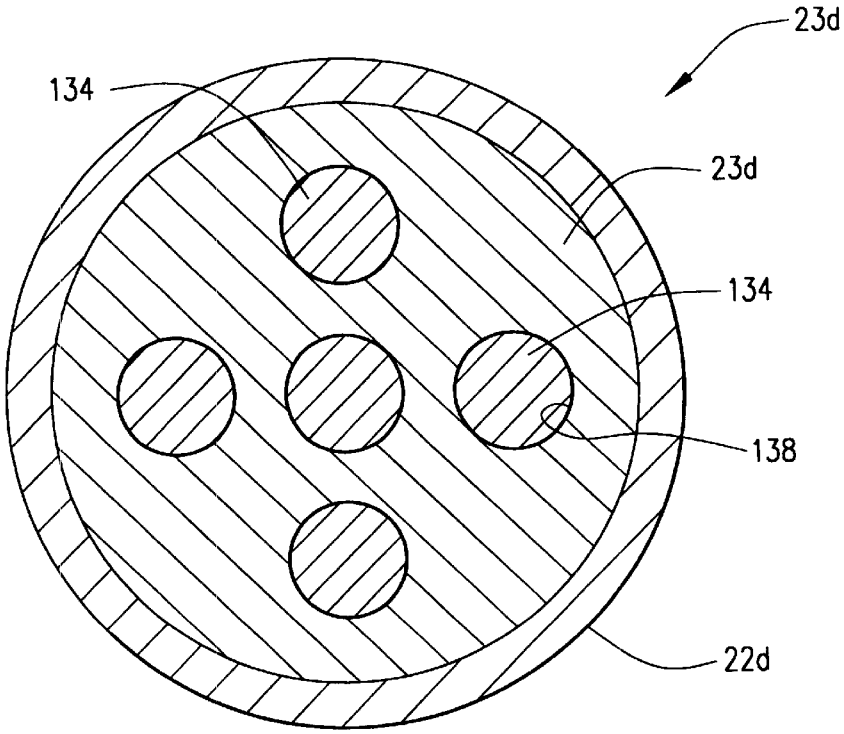
FIG. 29 shows a cross sectional view of the explosive assembly of FIG. 21A.

Referring now to FIGS. 21A and 29, the explosive charges are disposed separately within cavities 138 located in the pressurized chamber 130. A retainer 140, such as wax, may be used to seal each explosive charge 134 within a cavity 138 and isolate the explosive charges 134 during operation to prevent premature activation of the explosive charges 134.

The explosive charges 134 may be any type of charge capable of creating an explosive force within the pressurized chamber 130 so that the pressure is increased to the desired pressure within the pressurized chamber 130. Types of charges that may be used include low order explosives with a slow reaction time and which are not shock activated.

Referring back to FIGS. 21A and B, the activator 132 preferably comprises a generally circular plate 139 and a plurality of switches 141 (FIG. 30). The activator 132 is connected to the wire line cable 129 so it may receive electricity to activate the switches. The switches 141 are adapted to individually activate the explosive charges 134 when electricity is sent downhole via the wire line cable 129.

The activator 132 is shown in greater detail in FIG. 30. The switches 141 are disposed about the circular plate 139 in positions corresponding to the electric charges. The switches 141 are activated by electricity sent downhole to the activator 132 via the wire line cable 129. One or more of the switches may be activated to set off the explosive charges as desired.

The activator 132 is an electronic device capable of transferring an electric signal from the wire line cable 129 to the explosive charges 134. It will be understood that any device capable of detonating the electric charges at the desired time may be utilized. Examples of various other devices capable of detonating the electric charges are detonators fired by stepping switches or timed sequence ignitors. Igniting the charges in sequence allows for control of the pressure within the high pressure cylinder. The detonators are fired sequentially, each when the internal pressure is reduced to a preset level as the piston moves downward forcing the drainage device out into the formation.

Referring back to FIG. 21A, each switch 141 is connected to an explosive charge 134. The switches 141 may be activated in sequence once a desired pressure is reached within the pressurized chamber 130. This permits the explosive charges 134 to be activated over a period of time thereby extending the duration of the increased pressure within the pressurized chamber 130. The increase in pressure is used to drive the piston 136 downhole into the guide 44*a.*

The piston 136 has an upper portion 142 disposed within the pressurized chamber 130, a lower portion 144 extending from the pressurized chamber 130 a distance downhole into the guide 44*d,* and a downhole end 145. The piston 136 is axially movable within the apparatus as pressure is increased by the explosive force created by detonation of the explosive charges 134.

The movement of the piston 136 may be restricted by the dimensions of the housing 22*d.* The housing 22*d* may be provided with upper stop 146 to limit the upward movement of the piston 136, and lower stops 148 to limit the downward movement of the piston 136. Alternatively, the dimensions of the pressurized chamber 130 may be such that the housing itself restricts the movement of the piston 136.

The piston 136 may also be provided with seals 150 to prevent the loss of pressure from the pressurized chamber 130 as the piston 136 moves through the apparatus 10*d.* Seals may be provided at various locations such as on the piston 136, on the housing 22*d,* or combinations thereof.

While in the preferred embodiment shown in FIGS. 21A and B the explosive assembly 23*d* is a piston 136 driven by an explosive device, it should also be appreciated that the force generated by the explosive assembly may be generated by other devices such as the percussive force of FIGS. 2 and 9 or the hydraulic force of FIGS. 22A and B.

Referring back to FIGS. 21A and B, the disc assembly 24*d* preferably comprises a plurality of discs 66*d* stacked together within the guide 44*d* and adapted to provide a passageway for recovery of fluid. The disc assembly 24*d* has an uphole end 68*d* and a downhole end 70*d.*

Each disc 66*d* in the disc assembly 24*d* is positioned and adapted to receive the explosive force generated by the explosive assembly 23*d.* The uphole end 68*d* of the disc assembly 24*d* receives the explosive force from the downhole end 145 of the piston 136 and is forced downhole through the guide 44*a.* The downhole end 70*d* of the disc assembly 24*d* is adapted to be forced out an opening 71*d* in the housing 22*d* and into the subterranean formation 13.

The disc assembly 24*d* of FIG. 21B is provided with a starter disc 152 at the downhole end 70*d* of the disc assembly 24*d.* The starter disc 152 has a bit 154 connected thereto. The bit 154 is similar to the bit 82 on the first end of the drainage device 16 of FIGS. 2 and 8. The bit 154 enables the starter disc 152 to puncture the casing 28 and enter the subterranean formation 13.

Because of the size and shape of the discs 66*d,* the discs are capable of moving from the linear upper portion 46*d* around the curved middle portion 50*d* and through the directional downhole portion 48*d* of the guide 44*d.* When stacked together to form disc assembly 24*d* as shown in FIG. 21B, the discs 66*d* are capable of extending the entire length of the guide 44*d.* Furthermore, the discs 66*d* are capable of moving through the entire length of the guide 44*d* and negotiating any turns or curves in the guide 44*d.*

As shown in FIG. 21B, the disc assembly 24*d* comprises a plurality of discs 66*d.* As stated previously with respect to FIG. 2, it will be understood that the number of discs 66*d* used in the disc assembly 24*d* may vary. To accommodate various factors, such as the size of the guide and the desired depth of the penetration into the subterranean formation, the overall length of the disc assembly 24*d* may be varied, as long as the disc assembly 24*d* is drivable the desired distance into the subterranean formation.

It should be appreciated that the number of discs may be increased to extend a distance further through the sidewall 17 of the wellbore 12 and into the subterranean formation 13. The discs 66*d* are capable of entering the subterranean formation 13 whereby the discs are explosively impacted beyond the wellbore 12 and forced further into the subterranean formation 13. Discs 66*d* may be added into the guide 44*d* during operation to increase the overall length of the disc assembly 24*d.* Alternatively, some of the discs 66*d* may be removed to shorten the overall length of the disc assembly 24*d.*

Figure 23:
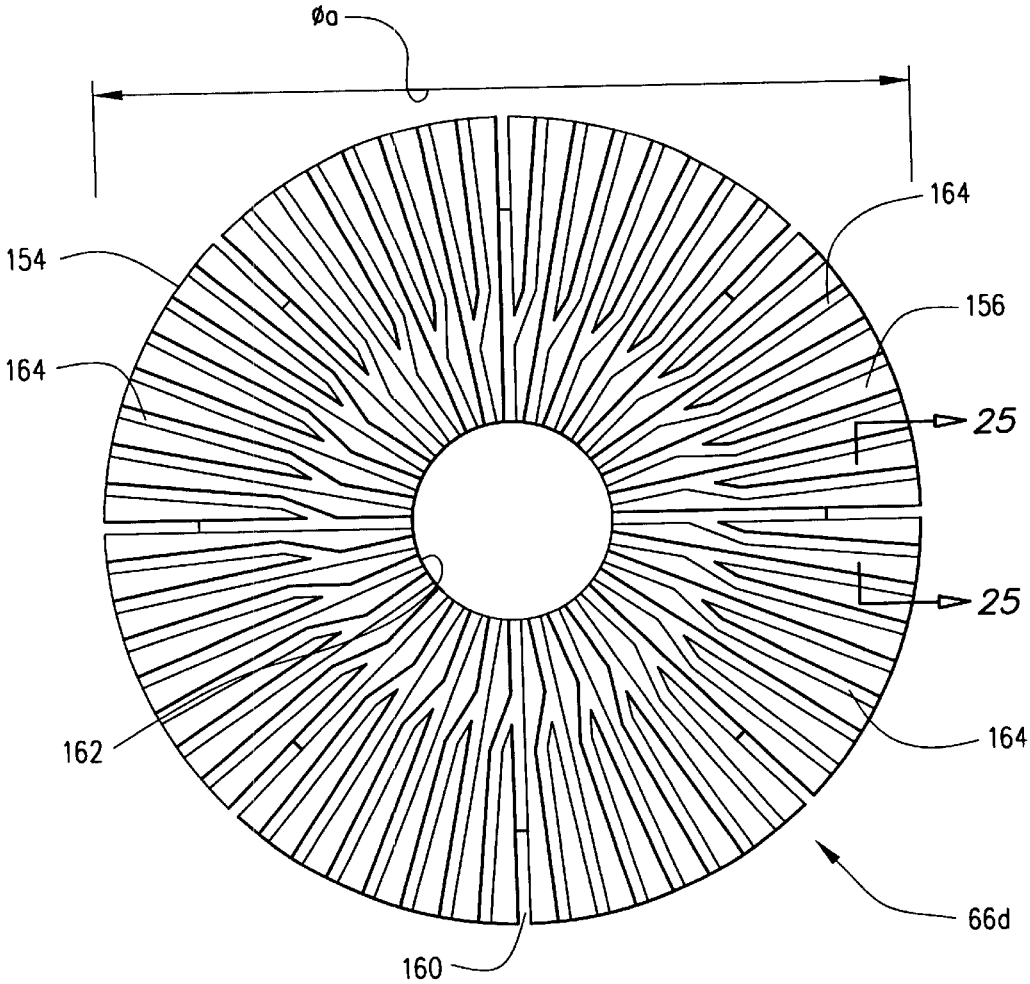
FIG. 23 shows a top view of another embodiment of the disc of FIG. 6, forming part of the anvil assembly shown in FIG. 21B.
Figure 24:
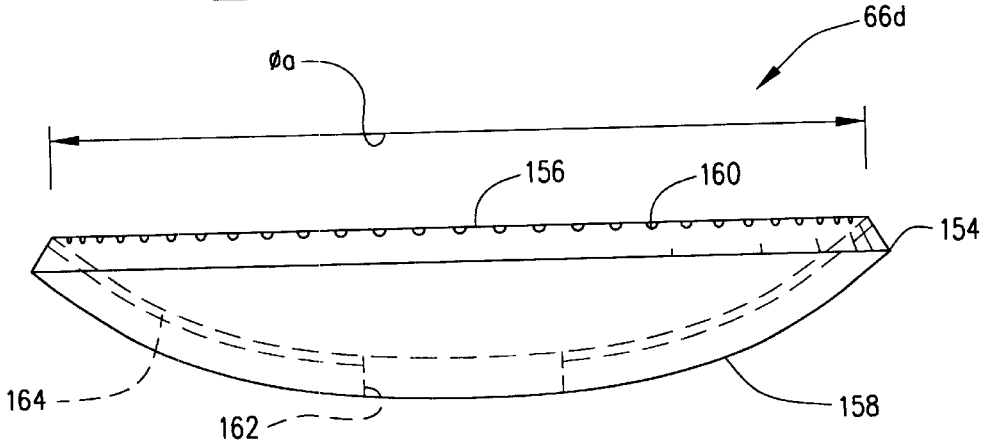
FIG. 24 shows a side elevational view of the disc of FIG. 23.
Figure 25:
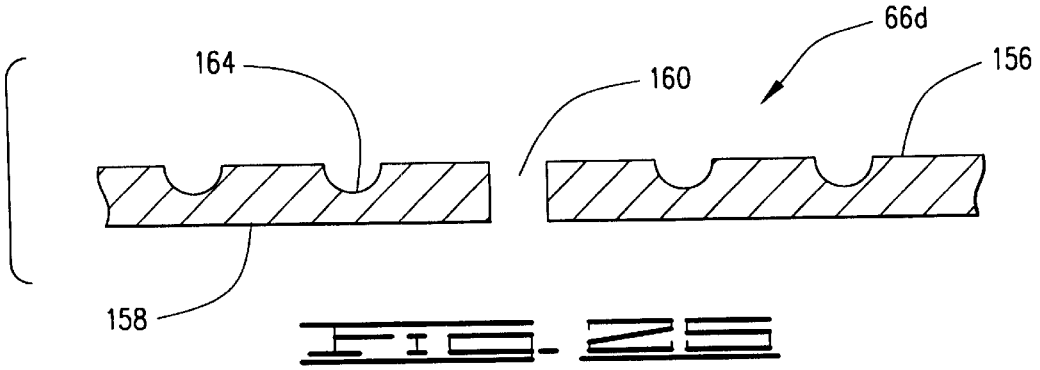
FIG. 25 shows a sectional view of the disc FIG. 23 taken along line 25—25 of FIG. 23.

Referring now to FIGS. 23 through 25, the discs 66*d* may be shaped similarly to the discs 66. Thus, the discs are generally circular with a circumference 154, an outwardly curved sidewall, a concave upper surface 156 and a convex lower surface 158. The discs 66*d* may be provided with notches 160 that enable the discs to compress further as they are forced through the guide 44*d*. The diameter "a" of the discs 66*d*, as seen in its relaxed or resting position, is slightly smaller than the internal diameter of the guide 44*d*.

Figure 31:
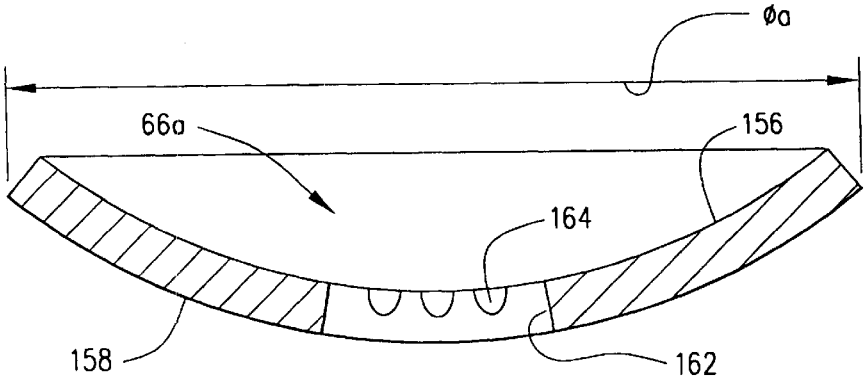
Figure 32:
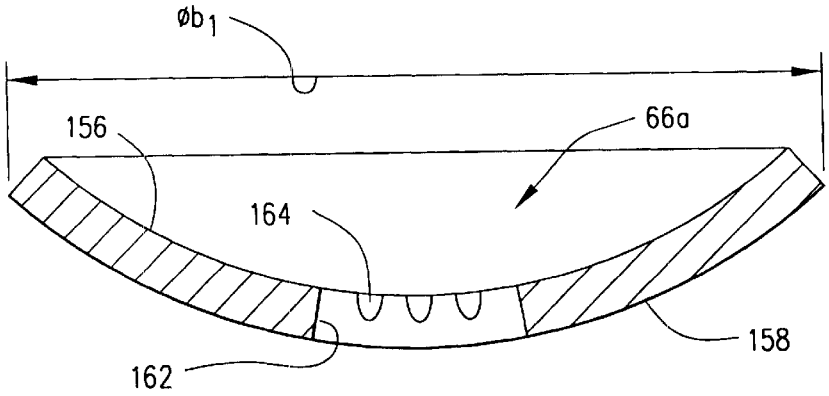
FIG. 32 shows a cross sectional view of the disc of FIG. 23 having a retracted diameter $b_1$.
Figure 33:
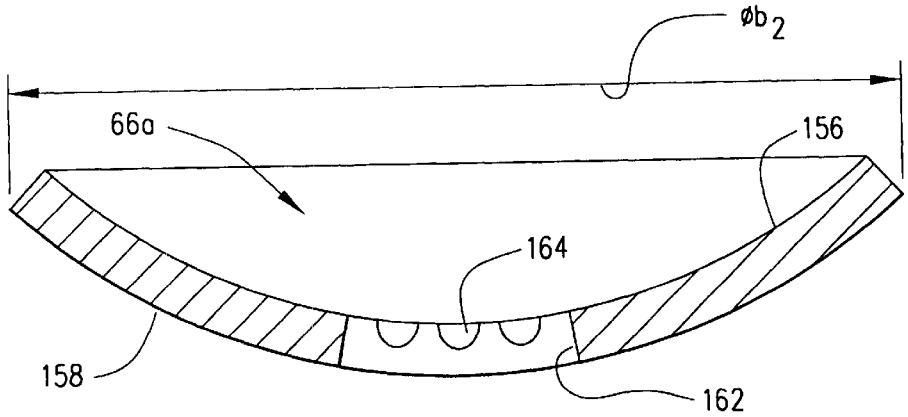
FIG. 33 shows a cross sectional view of the disc of FIG. 23 having an expanded diameter $b_2$.

FIGS. 31 through 33 show the discs 66*d* in a schematic form simply to illustrate the slight compression and expansion that the discs can undergo. As seen in FIG. 31, the resting diameter "a" (see also FIG. 24) is slightly smaller than the internal diameter of the guide 44*d* so that the discs can be pushed through the guide. The discs 66*d* are flexible to enable the discs to conform to the shape of the guide 44*d* as they pass through it. As stated previously with respect to the discs of FIGS. 2, 6 and 7, the discs are preferably made of metallized alluminum, but may be made of other flexible, sturdy materials.

As the discs 66*d* are driven into the guide 44*d*, the discs maintain their slightly smaller diameter relative to the guide diameter. As indicated, the discs are flexible and may compress, if necessary, to a slightly reduced diameter "$b_1$" (FIG. 32) as they are forced down the curved guide 44*d*. Once the discs are forced out into the formation, pressures in the formation may create a backward pressure. In this event, the discs 66*d* will widen slightly to diameter "$b_2$", as shown in FIG. 33, to frictionally engage the adjacent surfaces of the formation and resist any backward movement. Thus, while the discs are capable of being driven outward into the formation, concave shape resist reverse movement back toward the apparatus in the borehole.

The discs 66*d* preferably have a hole 162 therethrough to provide a passageway for the recovery of fluid therethrough. The fluid flow may be enhanced by providing the discs with a plurality of grooves 164 in the upper surface 156 to allow the flow of fluids through the guide 44*d* during operation. If the upper surface 156 is grooved, the lower surface 158 preferably is smooth. Further, the grooves preferably will be formed by some process that provides flattened interstitial spaces to slidably engage the adjacent flat undersurface of the disc above. It will be appreciated that the grooves could be provided on the underside of the discs, with the upper surfaces being smooth.

Referring back to FIGS. 21A and B, the apparatus 10*d* may be provided with a collar locator 168 capable of detecting predetermined positions in the well. The collar locator 168 is powered via the electricity provided by the wire line cable 129. Once the predetermined location is detected by the collar locator 168, the apparatus 10*d* may then be activated to dispose an object into the wellbore 12.

The apparatus 10*d* may also be provided with a back up device 170 located on the lower portion of the housing 22*d* opposite the opening 71*d*. The back up device 170 is positioned to contact the sidewall of the borehole opposite the location that the discs 66*d* are driven into the subterranean formation so that the back up device 170 may absorb the forces created and stabilize the apparatus within the borehole.

In operation, the apparatus 10*d* is lowered via a hoist to the desired location in the wellbore 12. The collar locator 168 detects the proper location within the wellbore. Once in position, the electricity may be sent downhole through wire line cable 129 to the activator 132. The switches 141 of the activator 132 detonate the explosive charges 134.

The explosive charges 134 explode within the pressurized chamber 130 to increase the pressure therein. The pressure build up in the pressurized chamber 130 causes the piston 136 to move axially downhole into the guide 44*d*. As the piston 136 moves further downhole into the guide 44*d*, the downole end 145 of the piston 136 impacts the uphole end 68*d* of the disc assembly 24*d*. The disc assembly 24*d* is forced through the guide 44*d* towards the opening 71*d* in the housing 22*d*.

The explosive force generated by the explosive assembly 23*d* is transferred to each disc 66*d* of the disc assembly 24*d*. The explosive force drives the discs 66*d* downhole through the guide 44*d* until the discs are eventually forced out the opening 71*d* in the housing 22*d*. The discs 66*d* are then forced through the casing 28, the concrete 30, the sidewall 17 of the wellbore 12 and into the surrounding formation 13, whereby the effective diameter of the wellbore 12 is increased.

The operation continues in a sequential mode until the discs 66*d* are extended the desired distance into the subterranean formation 13. Also, the activator may be repeatedly activated so that the switches detonate additional charges and drive the disc assembly further into the subterranean formation. Upon completion, the hoist may then be used to remove the apparatus 10*d* from the wellbore 12.

Turning to FIGS. 22A and B, a sixth embodiment of the present invention is shown. The apparatus 10*e* preferably comprises a housing 22*e* movably positionable within the wellbore 12, a propulsion assembly such as hydraulic assembly 23*e* capable of imparting a hydraulic force, an anvil assembly such as disc assembly 24*e* capable of transmitting the hydraulic force to a drainage device 16*e*, and a dual anchor 26*e*.

The housing 22*e* of the apparatus 10*e* preferably is generally cylindrical with an uphole end 18*e*, a downhole end 20*e*, an uphole portion 40*e* and a downhole portion 42*e*. The downhole portion 42*e* of the housing 22*e* is hollow with a tubular guide 44*e* therein. The tubular guide 44*e* is supported within the housing 22*e* via supports 183.

The apparatus 10*e* is disposable a distance downhole within the wellbore 12. The apparatus 10*e* may be lowered downhole into position as described previously with respect to FIG. 2 using drill pipe or tubing 195 threadably connected to the uphole portion 40*e* of the housing 22*e*.

Referring back to FIG. 22B, the apparatus 10*e* may be provided with a dual anchor 26*a* threadably connected to the downhole end 20*e* of the apparatus 10*e*. The dual anchor 26*a* is capable of securing the apparatus 10*e* in the wellbore so that the apparatus 10*e* resists movement in the uphole and/or the downhole direction.

Figure 26:
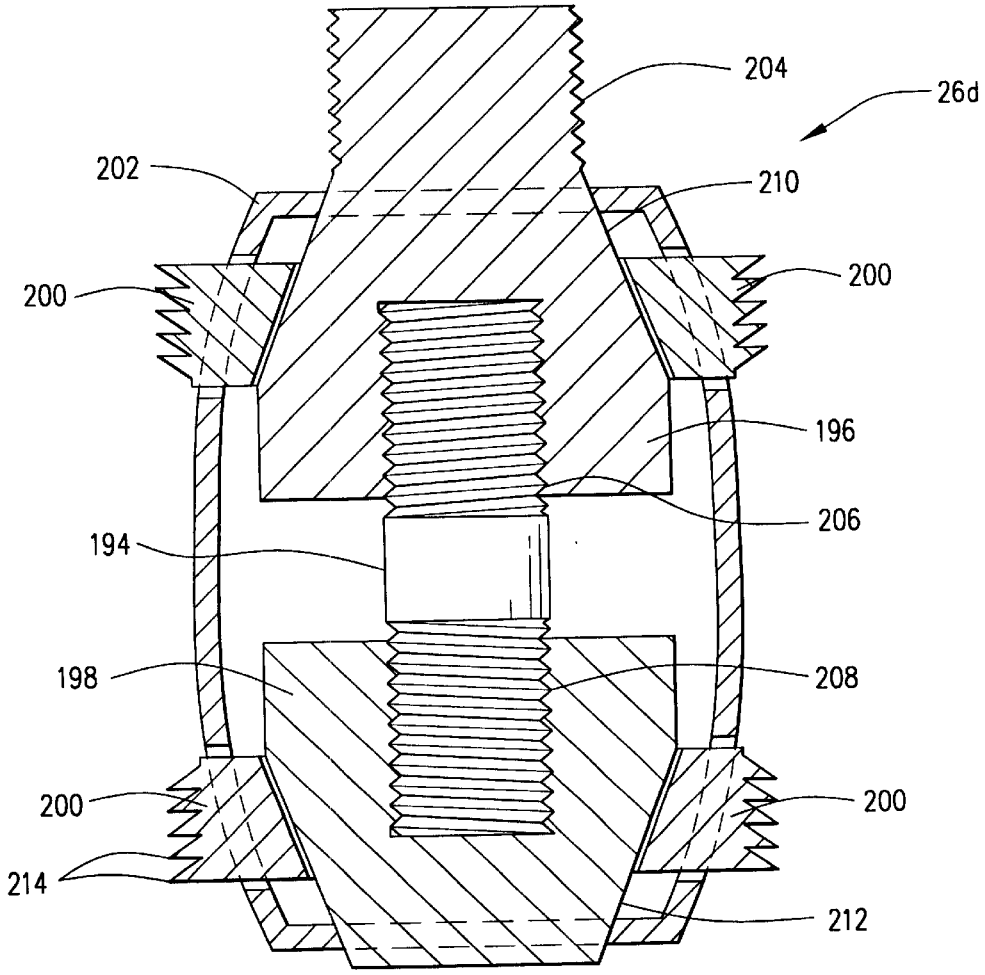
FIG. 26 shows a longitudinal sectional view of the anchor assembly of FIG. 22B.

Referring now to FIG. 26, the dual anchor 26*e* of apparatus 10*e* is depicted in greater detail. The anchor 26*e* comprises a standard type double acting anchor used in the oil and gas industry, which has been modified in accordance with the present invention. The anchor 26*e* preferably comprises a central portion 194, an upper portion 196, a lower portion 198, a plurality of slips 200, and a drag spring 202. The upper portion 196 is removably connected to the lower end 20*e* of the apparatus via threads 204.

The upper portion 196 is threadably connected to the central portion 194 of the anchor 26*e* via threads 206, and the lower portion 198 is threadably connected to the opposite end of the central portion 194 of the anchor 26*e* via threads 208. Threads 206 and 208 are threaded in opposite directions so that as the upper portion 196 and lower portion 198 are rotated clockwise the upper portion 196 and lower portion 198 are driven closer together. Similarly, as the upper portion 196 and lower portion 198 are rotated counter clockwise, they are driven farther apart.

The upper portion 196 has a generally cylindrical body with a tapered surface 210 that tapers away from the central portion of the anchor. The lower portion 198 has a generally cylindrical body with a tapered surface 212 that tapers away from the central portion 194 of the anchor 26*e*. The upper portion 196 and the lower portion 198 are provided with slips 200 connected thereto. The slips 200 are disposed on the upper portion 196 and the lower portions 198 so that they extend radially about the anchor 26*e*.

The slips 200 are movably connected along the tapered surface 210 of the upper portion 196 and the tapered surface 212 of the lower portions 196. The slips 200 are capable of moving along the tapered surfaces between an extended and retracted position. As the slips 200 are moved along the tapered surfaces toward the central portion 194, the slips 200 extend radially outward so that the overall diameter of the anchor 26*e* is expanded. As the slips 200 are moved along the tapered surfaces away from the central portion 194, the slips 200 retract inwardly so that the overall diameter of the anchor 26*e* is reduced.

The slips 200 are provided with a plurality of teeth 214 which are adapted to frictionally engage the sidewall 17 (FIG. 22B) of the wellbore 12 and resist movement therefrom. As the slips 200 are moved to the extended position, the teeth 214 are capable of contacting the sidewall 17 of the wellbore 12. As the slips 200 are moved to the retracted position, the teeth 214 are released from the sidewall 17 of the borehole 12.

The drag spring 202 is disposed about the anchor 26*e* with the slips 200 extending therethrough. The drag spring 202 is adapted to frictionally engage the sidewall 17 of the wellbore 12 and resist rotation.

The anchor 26*e* is set by rotating the apparatus 10*e* counterclockwise, then applying upward tension on the apparatus 10*e*. The drag spring 202 engages the sidewall 17 and resists rotation. It is released by rotating the device clockwise and releasing the tension.

As that anchor 26*e* is rotated counterclockwise, the upper portion 196 and the lower portion 198 of the anchor 26*e* move apart. The slips 200 of the anchor 26*e* are moved to the extended position so that the slips 200 extend radially about the anchor 26*e*. The teeth 214 engage the sidewall 17 of the wellbore 12 and prevent the apparatus 10*e* from moving within the wellbore 12.

With continuing reference to FIGS. 22A and B, the guide 44*e* preferably defines an elongate aperture within the guide 44*e* adapted to hold the drainage device 16*e* in the proper orientation for release. As seen in the embodiments of FIGS. 2 and 9, the guide 44*e* preferably comprises a generally linear upper portion 46*e*, a directional downhole portion 48*e* and a middle portion 50*e* therebetween. The directional downhole portion 48*e* is configured to direct the drainage device 16*e* to the desired location within the subterranean formation 13 and at the desired orientation.

The middle portion 50*e* defines a transition area between the upper portion 46*e* and lower portion 48*e*, and preferably defines an elbow linking the linear upper portion 46*e* to the directional downhole portion 48*e* at a radius sufficient to permit the drainage device 16*e* to pass through the guide 44*e*.

A stated previously with respect to guide 44 of FIG. 2, the shape of the guide 44*e* and the orientation of the directional downhole portion 48*e* determine the angle at which the object exits the guide 44*e* and penetrates the subterranean formation 13. In the embodiment shown in FIGS. 22A and B, the linear portion 46*e* of the guide 44*e* forms a 90 degree angle to the directional downhole portion 48*e*, thereby creating a 90 degree exit angle for the drainage device 16*e*.

With continuing reference to FIGS. 22A and 22B, the hydraulic assembly 23*e* will be described. The assembly 23*e* generally comprises a piston 136*e* to impact the disks 24*e* or other objects positioned within the guide channel 44*e* in housing 22*e* and a hydraulic pump 215 to create an axial force on the piston 136*e*.

The piston 136*e* comprises a shaft 52*e* having an upper end 216 and a lower end 217. The lower end 217 extends into the upper portion 46*e* of the guide channel 44*e* above the disks 24*e* (FIG. 22B). The upper end 216 is contained within a piston chamber 218. The upper end 216 is provided with a pressure plate 219 that moves axially in the piston chamber 218. The circumferential edges of the piston plate 219 sealingly contact the inner wall defining the piston chamber 218 by means of seals 220 or the like. Now it will be seen that the piston plate 219 divides the piston chamber 218 into an upper portion and a lower potion, the upper portion being referred to herein as a fluid receiving chamber described hereafter.

The hydraulic pump 215 comprises a ram 221 with an upper rod portion 222 and a lower piston portion 223 connected in between by a ram plate 224. The rod 222 extends upwardly from the rain plate 224 and connects to the downhole end of the drill pipe 195. In this way, axial movement of the drill pipe 195 from the surface will control the movement of the ram 221. The ram piston 223 comprises a stem 225. The upper end 226 of the stem 225 is fixed to the lower surface of the ram plate 224. A head 227 is fixed on the lower end 228 of the stem 225.

The ram plate 224 is contained within a ram chamber 229 defined by the upper portion of the housing 40*e* and a partition 230. Though not shown in detail in FIG. 22A, the ram rod 222 is releasably locked by means of a lock assembly 36*e* to the upper portion 40*e* of the housing as described previously in connection with the lock assembly 36 of the embodiment of FIG. 12. In this way, the assembly 10*e* is supportable on the end of the drill pipe 195 by the ram rod 222 without movement of the ram within the assembly. Once positioned, the lock assembly 36*e* is released permitting axial movement of the drill string and ram assembly within the housing 22*e*.

The piston head 227 is contained within a pressure transfer chamber 231. A fluid reservoir 232, preferably beneath the pressure transfer chamber 231, contains a supply of hydraulic fluid (not shown). This fluid is transferred to the pressure transfer chamber 231 via the conduit 233. A fluid receiving chamber 234, preferably the upper portion of the piston chamber 218, is provided in the pump 215 preferably below the fluid reservoir 232. Fluid is transferred from the pressure transfer chamber 231 to the fluid receiving chamber 234 (the upper portion of the piston chamber 218) via the conduit 235. A one-way valve 236 ensures that fluid moves only into the pressure transfer chamber 231 from the fluid reservoir 232. A one-way valve 237 ensures that fluid moves only into the fluid receiving chamber 234 from the pressure transfer chamber 231.

A seal, such as the seal 190, is provided to seal the periphery of the piston head 227 to the inside wall of the fluid transfer chamber 231. Seals, such as the seals 192, are provided between the partition 230 and the stem 225 to provide a fluid tight seal therebetween.

Once the apparatus 10*e* is installed at the selected location in the well and the lock assembly 36*e* is released, the hydraulic pump 215 is operated. First, the ram rod 222 is pushed downwardly by using the drill string 195. This in turn moves the piston head 227 downwardly in the pressure transfer chamber 231. This creates negative pressure in the chamber 231 causing fluid to move from the fluid reservoir 232 into the pressure transfer chamber.

At the end of the downward stroke of the ram 221, the ram is then pulled upwardly by the drill string 195. This moves the piston head 227 upwardly in the pressure transfer chamber 231. Because of the one-way valve 236, fluid is forced by the increasing positive pressure into the fluid receiving channel 234 through the conduit 235. As fluid enters the fluid receiving channel 234, the increasing pressure forces the pressure plate 219 downwardly in the piston chamber 218 and thus the shaft 52*e* downward in the guide 44*e* to impact the disks 24*e*. At the completion of this cycle, the apparatus 10*e* can be removed and reused as necessary.

While in the preferred embodiment shown in FIGS. 22A and B the hydraulic assembly 23*e* is a piston driven by a hydraulic device, it should also be appreciated that the force generated by the propulsion assembly may be generated by other devices.

As seen in FIG. 22A and B, the disc assembly 24*e* preferably comprises a plurality of discs 66*e* stacked together within the guide 44*e*. The disc assembly 24*e* has an uphole end 68*e* and a downhole end 70*e*.

The discs of FIG. 22B preferably are the same discs used in FIG. 21B. Each disc 66*e* in the disc assembly 24*e* is positioned and adapted to receive and transmit the hydraulic force generated by the hydraulic assembly 23*e*. The uphole end 68*e* of the disc assembly 24*e* receives the hydraulic force from the shaft 52*e* of the piston 136*e* and transmits the force through the disc assembly 24*e* to the drainage device 16*e*. The downhole end 70*e* of the disc assembly 24*e* is adapted to impact the drainage device 16*e* whereby the drainage device 16*e* is forced out an opening 71*e* in the housing 22*e* and into the subterranean formation 13.

Because of the size and shape of the discs 66*e*, the discs are capable of moving from the linear upper portion 46*e* around the curved middle portion 50*e* and through the directional downhole portion 48*e* of the guide 44*e*. When stacked together to form an disc assembly 24*e* as shown in FIG. 22B, the discs 66*e* are capable of extending the entire length of the guide 44*e*. Furthermore, the discs 66*e* are capable of moving through the entire length of the guide 44*e* and negotiating any turns or curves in the guide.

As shown in FIG. 22B, the disc assembly 24*e* comprises a plurality of discs 66*e*. It should be understood, however, that the number of discs 66*e* used in the disc assembly 24*e* may vary. To accommodate various factors, such as the size of the guide and the desired depth of the object, the overall length of the anvil assembly may be varied, as long as the hydraulic force is transferable through the guide to the object.

It should be appreciated that the number of discs may be increased to push the object a distance further into the sidewall 17 of the wellbore 12 and into the subterranean formation 13. The discs 66*e* are capable of entering the subterranean formation 13 with the object whereby the object is driven beyond the wellbore 12 and forced further into the subterranean formation 13. Discs 66*e* may be added into the guide 44*e* during operation to increase the overall length of the disc assembly 24*e*. Alternatively, the discs 66*e* may be removed to shorten the overall length of the disc assembly 24*e*.

Referring still to FIG. 22B, the object preferably is a drainage shaft 16*e* adapted to be impacted by the hydraulic assembly 23*e* and driven through the wellbore 12 into the subterranean formation 13. The second end 80*e* is positionable near the disc assembly 24*e* and is adapted to receive a force. The drainage device 16*e* may be provided with the features heretofore described in the drainage devices of FIGS. 2 and 6, and additionally provided with resistors such as seals 238.

Shown in more detail in FIG. 27, the drainage device 16*e* is hollow and generally cylindrical having a first end 78*e*, a second end 80*e* and a plurality of seals 238. The seals 238 are located near the second end 80*e* of the drainage device 16*e*. The seals 238 adhere to the casing 28 as the drainage device 16*e* is driven into the sidewall of the borehole. The seals 238 prevent the flow of fluid between the drainage device 16*e* and the casing 28 thereby maximizing the flow of fluids from the subterranean formation 13 into the apparatus 10*e*.

It will be understood that while the drainage device of FIG. 27 is provided with resistors in the form of seals, other resistors may be used to prevent the flow of fluid between the drainage device 16*e* and the casing 28. For example, FIG. 28 shows another embodiment of the drainage device with a plurality of teeth 238*f* located at the second end 80*f* of the drainage device 16*f*. The teeth 238*f* also enable the drainage device to be driven into the sidewall of the wellbore and resist retraction therefrom.

In operation, the apparatus 10*e* is lowered via the pipe 195 to the desired location in the wellbore 12. As sections are added to the pipe 195, the apparatus may be lowered further into the wellbore. The apparatus 10*e* is then locked into the desired position via the anchors 26*e*.

The force generated by the hydraulic assembly 23*e* is transferred through each disc 66*e* of the disc assembly 24*e* to the drainage shaft 16*e*. As the discs 66*e* are driven by the piston 136*e*, the downhole end 70*e* of the disc assembly 24*e* impacts the drainage shaft 16*e*. The discs 66*e* and the drainage shaft 16*e* are forced through the guide 44*e* and out the opening 71*e* in the housing 22*e*. The drainage shaft 16*e* is then forced through the casing 28, the concrete 30, the sidewall 17 of the wellbore 12 and into the surrounding formation 13, whereby the effective diameter of the wellbore 12 is increased.

Upon completion, the apparatus 10*e* is then rotated to release the anchors 26*e*. The apparatus may then be removed by removal of the pipe 195 from the wellbore 12.

The efficacy of the apparatus and method of this invention is illustrated by the following working examples.

Casing Penetration Test Configuration and Data

Object a) Determine if a pointed shaft can be pushed through the wall of high quality steel, oil and gas well casing from inside the round pipe, as opposed to drilling a hole from the inside out by rotating a flexible shaft.

b) Determine the compressive force required to push a pointed, two inch diameter shaft through casing commonly used in oil and gas wells.

c) Determine the effect of the shape of the point, in force required for penetration d) Determine the effect of the diameter of the shaft, in the force required for penetration Test stand: High pressure, hydraulic cylinder, with 5 inch diameter internal piston, anchored between two "I" beams with the steel pipe supported and backed by oak lumber. The test stand allows for the force to be applied perpendicular to the wall of the steel pipe. Hydraulic pressure is supplied by a port-a-power pump.

Compressive force: The force generated by the test stand is the hydraulic pressure acting on the cross-sectional area of the hydraulic cylinder. In this test stand, the 5 inch hydraulic cylinder would have an internal area of:

3.1416×radius squared=3.1416×(2.5×2.5)=19.635 square inches

Force in pounds equals the measured pressure in psi times the area, 10.635 inches.

| TEST CONDITIONS | | |
|---|---|---|
| | Pressure to penetrate wall | Pressure to open to 2" Diameter |
| 5.500 Inch Diameter 15.5 Pounds/Foot J Grade Pipe (Wall 0.260 Inches Thick) | | |
| 1) Sharp Point | | |
| sample a) | 950 psi F = 18,653# | 810 psi F = 15,904# |
| sample b) | 940 psi F = 18,457# | 840 psi F = 16,493# |
| sample c) | 920 psi F = 18,064# | 870 psi F = 17,082# |
| 2) Rounded Point | | |
| sample a) | 970 psi F = 19,046# | 840 psi F = 16,493# |
| sample b) | 1,020 psi F = 20,028# | 860 psi F = 16,886# |
| sample c) | 1,050 psi F = 20,617# | 850 psi F = 16,690# |
| 5.500 Inch Diameter 15.5 Pounds/Foot J 55 Grade Pipe | | |
| 2) Chisel Pt (1 in.) | | |
| sample a) | 980 psi F = 19,242# | 840 psi F = 16,493# |
| sample b) | 1,040 psi F = 20,420# | 880 psi F = 17,279# |
| sample c) | 1,020 psi F = 20,028# | 870 psi F = 17,082# |
| 7.000 Inch Diameter 26.0 Pounds/Foot P 110 Grade Pipe (Wall 0.375 Inches Thick) | | |

Samples: Using a shaft with a sharp point, it was impossible to penetrate the steel wall without breaking the point from the shaft. The point was brittle on the end that contacted the casing and required too much force to deform the material.

Sample a) Using a shaft with a point 0.375 inches in diameter and having a rounded point near the size of a used wood-pencil eraser, the pressure to penetrate the casing was 1,760 psi, with a resultant force of 34,558 pounds. Point was made from tungston-carbide rotary bit insert.

1) Once the point went through the casing, the pipe shattered or split out radially in more than one direction, but the preference was up and down the pipe.
2) Opening the hole up to 2 inches in diameter, after the point went through, causes the pipe to split rather than tear and the force is less than 20,000 pounds.

Sample b) Using a rounded point and a shaft composed of "nested washers" prepressed into half-moon configuration (which allows the shaft to follow around a 90 degree elbow guide), a 2 inch diameter hole can be made in the P-110 casing with a force of (1,980 psi) 38,877 pounds.

CONCLUSIONS

1) Making a hole through steel casing can be readily accomplished by using force to push the point through instead of drilling by twisting a shaft and bit.

2) The shape of the point does not determine the force necessary to make a hole in the casing. If the point is large enough to spread the loading for deformation, a hole can be made that is almost independent of shape of the point.

3) Once the point goes through the wall of the pipe, it requires less force to make the hole larger than the force to penetrate the wall.

4) Making the hole larger in J 55 grade casing is done by elastic deformation and tearing. Making the hole larger in P 110 grade casing is done by shattering or splitting.

It should be appreciated that an object, such as the drainage and expansion devices depicted herein may be formed integrally within or pre-loaded into a casing before inserting the casing into the wellbore. It should be appreciated that any object of any dimension may be used which increases the size of the wellbore. Additionally, the object may be formed from various materials and combinations thereof. Such materials used to form the object may be flexible, such as PVC pipe, or more sturdy, such as stainless steel. Materials that may used to form the object include steel, ceramics, wood, synthetics, or plastics. Objects acting as drainage devices are known in the industry and come in a variety of sizes, shapes, and materials. Such drainage devices are disposable within wellbores for generating fluid flow. Such devices may be provided with filters and screens for controlling the flow of fluids and other particles into the wellbore.

While the invention has been described with a certain degree of particularity, it is manifest that many changes may be made in the details of construction and arrangement of components without departing from the spirit and scope of this disclosure. It is understood that the invention is not limited to the embodiments set forth herein for purposes of exemplification, but is to be limited only by the scope of the attached claims, including the full range of equivalency to which each element thereof is entitled.

What is claimed is:

1. A pre-loaded casing for use in increasing the effective diameter of a well bore, the casing comprising:

a casing defined by a sidewall, the sidewall having at least one aperture therethrough; and a drainage device for the at least one aperture in the casing sidewall, the drainage device movable between a stored position and an extended position, wherein in the stored position the drainage device is contained inside the casing section, and wherein in the extended position the drainage device extends through and a distance beyond the aperture in the sidewall of the casing section, wherein the drainage device comprises an external drainage channel.

2. The pre-loaded casing of claim 1 wherein the drainage device is a cylindrical member, and wherein the casing comprises a guide channel for supporting the drainage device and directing its path of movement through the sidewall, and wherein the drainage device is contained in the guide channel in the storage position.

3. The pre-loaded casing of claim 1 wherein the external drainage channel comprises a helical groove.

4. A system for use in increasing the effective diameter of a well bore, the casing comprising:

a casing defined by a sidewall, the sidewall having at least one aperture therethrough;

an expansion device for the at least one aperture in the casing sidewall, the expansion device movable between a stored position and an extended position, wherein in the stored position the expansion device is contained inside the casing section, and wherein in the extended position the expansion device extends through and a distance beyond the hole in the sidewall of the casing section;

an operating string extending from a distance above the casing to the casing;

a propulsion assembly supported on an end of the operating string adapted to output downward axial force, and wherein the propulsion assembly includes a downwardly extending shaft to receive and transmit the axial force; and a bit supported on the shaft and sized to move through the inside of the casing and force the at least one expansion device from the stored position toward the extended position in response to axial force from the shaft.

5. The system of claim 4 wherein the expansion device is a drainage device.

6. The system of claim 5 wherein the drainage device is a cylindrical member with a drainage channel, and wherein the casing comprises a guide channel for supporting the drainage device and directing its path of movement through the sidewall, and wherein the drainage device is contained in the guide channel in the storage position.

7. The system of claim 6 wherein the drainage channel in the cylindrical member is external.

8. The system of claim 7 wherein the external drainage channel comprises a helical groove.

9. The system of claim 4 wherein the propulsion assembly comprises a hammer.

10. The system of claim 4 wherein the propulsion assembly is pneumatically driven.

11. The system of claim 4 wherein the propulsion assembly is hydraulically driven.

12. The system of claim 4 wherein the propulsion assembly is explosively driven.

13. The system of claim 4 further comprising a hole opener supported on the shaft a distance above the bit, the hole opener being adapted to force the expansion device further toward the extended position.

14. The system of claim 13 wherein the hole opener comprises at least one finger radially extendable and adapted to force the at least one expansion device further toward the extended position.

15. The system of claim 13 wherein the hole opener comprises:

a first portion comprising a frusto-conical body non-movably supported on the shaft of the propulsion assembly; and a second portion slidably supported on the shaft and having a hollow, cylindrical body sized to receive the first portion and having a sidewall divided longitudinally into a plurality of resilient fingers whereby the fingers will expand radially when the first portion is received inside the body and return to the non-expanded position when the first portion is withdrawn from the body.

* * * * *